US005706654A

United States Patent [19]

Nagai

[11] Patent Number: 5,706,654

[45] Date of Patent: Jan. 13, 1998

[54] AIR-FUEL RATIO CONTROL DEVICE FOR AN INTERNAL COMBUSTION ENGINE

[75] Inventor: Toshinari Nagai, Sunto-gun, Japan

[73] Assignee: Toyota Jidosha Kabushiki Kaisha, Toyota, Japan

[21] Appl. No.: 616,493

[22] Filed: Mar. 19, 1996

[30] Foreign Application Priority Data

Mar. 27, 1995 [JP] Japan ..... 7-067894

[51] Int. Cl.[6] ..... F01N 3/20; F02D 41/14

[52] U.S. Cl. ..... 60/276; 60/285; 123/674

[58] Field of Search ..... 60/274, 276, 285; 123/674, 675

[56] References Cited

U.S. PATENT DOCUMENTS

| | | | |
|---|---|---|---|
| 5,193,339 | 3/1993 | Furuya | 123/674 |
| 5,251,437 | 10/1993 | Furuya | 60/276 |
| 5,255,662 | 10/1993 | Nakajima | 123/674 |
| 5,337,557 | 8/1994 | Toyoda | 60/276 |
| 5,341,641 | 8/1994 | Nakajima et al. | 60/276 |
| 5,361,582 | 11/1994 | Uchida et al. | 60/276 |
| 5,491,975 | 2/1996 | Yamashita et al. | 60/276 |
| 5,579,637 | 12/1996 | Yamashita et al. | 60/276 |
| 5,598,702 | 2/1997 | Uchikawa | 123/674 |

FOREIGN PATENT DOCUMENTS

| | | |
|---|---|---|
| 1-318735 | 12/1989 | Japan . |
| 2-11843 | 1/1990 | Japan . |
| 4-17749 | 1/1992 | Japan . |

*Primary Examiner*—Willis R. Wolfe
*Attorney, Agent, or Firm*—Oliff & Berridge, P.L.C.

[57] ABSTRACT

In the present invention, the air-fuel ratio of an engine is controlled by a fist air-fuel ratio control based on the output of an $O_2$ sensor disposed in an exhaust gas passage downstream of a catalytic converter, and by a second air-fuel ratio control based on the output of an $O_2$ sensor disposed downstream of the catalytic converter. The first air-fuel ratio control determines the air-fuel ratio correction factor FAF in accordance with the output of the downstream $O_2$ sensor and a second air-fuel ratio correction factors RSR and RSL. The second air-fuel ratio control determines the values of RSR and RSL in accordance with the output of upstream $O_2$ sensor. Further, a learning correction of FAF is performed in such a manner that the center value of the fluctuation of FAF agrees with a reference value. When the center value of FAF deviates from the reference value, since the values RSR and RSL fluctuate largely, the fluctuation of FAF also becomes large. This may cause an error in the learning correction. In the present invention, when the center value of FAF deviates from the reference value, the rate of change in the values RSR and RSL is reduced, to thereby suppress the fluctuation thereof. Therefore, the fluctuation of FAF is also suppressed to prevent an error in the learning correction from occurring without interrupting the second air-fuel ratio control.

4 Claims, 16 Drawing Sheets

AIR-FUEL RATIO CONTROL DEVICE FOR AN INTERNAL COMBUSTION ENGINE

BACKGROUND OF THE INVENTION

1. Field of the Invention

This invention relates to an air-fuel ratio control device for an internal combustion engine, and more particularly, relates to an air-fuel ratio control device which performs a learning correction of the air-fuel ratio in order to compensate for changes in the characteristics of the elements in the fuel supply system.

2. Description of the Related Art

An air-fuel ratio control device which maintains the operating air-fuel ratio of an internal combustion engine at a predetermined target air-fuel ratio by controlling the amount of the fuel supplied to the engine is commonly used. In such a device, the amount of the fuel supplied to the engine is controlled in accordance with the value of an air-fuel ratio correction factor. The air-fuel ratio correction factor is calculated in accordance with the output of an air-fuel ratio sensor disposed in an exhaust gas passage of the engine. Further, in this type of air-fuel ratio control, a learning correction factor is used for adjusting the value of the air-fuel ratio correction factor so that it fluctuates around a predetermined center value even when the characteristics of the elements in the fuel supply system deviate from the design characteristics. Usually, the value of the air-fuel ratio correction factor fluctuates in accordance with the change in the output of the air-fuel ratio sensor, and the center value of the fluctuation agrees with a predetermined reference value if the characteristics of the elements in the fuel supply system agree with the design characteristics. However, when the characteristics of the elements, such as an airflow meter or a fuel injection valve deviate from the design characteristics, the center value of the fluctuation of the air-fuel ratio correction factor also deviates from the reference value to keep the operating air-fuel ratio of the engine at the target air-fuel ratio. Namely, in such an air-fuel ratio control device, the air-fuel ratio of the engine can be maintained at the target air-fuel ratio by shifting the center value of the air-fuel ratio correction factor from the reference value even if the characteristics of the elements deviate from the design characteristics. However, the value of the air-fuel ratio correction factor is usually restricted by an upper limit and a lower limit as explained later. Therefore, the value of the air-fuel ratio correction factor cannot take a value beyond the range defined by the upper limit value and the lower limit value. Accordingly, if the center value of the air-fuel ratio correction factor deviates from the reference value and approaches one of the limit values, the range between the center value and the limit value to which the center value approaches becomes smaller. When this occurs, the air-fuel ratio correction factor cannot take a value sufficiently different from the center value, and therefore, the range of air-fuel ratios which can be controlled by changing the value of the air-fuel ratio correction factor becomes smaller.

Therefore, to prevent this problem, usually, another correction factor, i.e., a learning correction factor is used for compensating for the deviations of characteristics of the elements, to thereby have the center value of the air-fuel ratio correction factor agree with the reference value. When the learning correction factor is employed, if the center value of the air-fuel ratio correction factor deviates from the center value, the value of the learning correction factor is changed so that the center value of air-fuel ratio correction factor agrees with the reference value. Namely, the deviations of the characteristics of the elements are compensated by the learning correction factor, and the air-fuel ratio correction factor corrects only the deviation of air-fuel ratio from the target air-fuel ratio due to the change in the operating conditions of the engine. Thus, by using the learning correction factor, the controllable range of the air-fuel ratio is not narrowed even if the characteristics of the elements deviate from the design characteristics.

An air-fuel ratio control device of this type is disclosed, for example, in Japanese Unexamined Patent Publication (Kokai) No. 4-17749. The device in the '749 publication calculates the air-fuel ratio correction factor in accordance with a first air-fuel ratio correction factor and a second air-fuel ratio correction factor which are determined in accordance with the outputs of air-fuel ratio sensors disposed in the exhaust gas passage upstream and downstream of a catalytic converter, and the device also determines the value of the learning correction factor so that the center value of the fluctuation of the air-fuel ratio correction factor agrees with a predetermined reference value. In the '749 publication, the operating range of the engine is divided into plural sections, and the device calculates the value of the learning correction factor separately for the respective operating sections when the engine is operated at the respective operating sections. Further, the device in the '749 publication determines whether the learning correction of the air-fuel ratio correction factor is completed in the respective operating sections, i.e., whether the center value of the air-fuel ratio correction factor agrees with the reference value in the respective operating sections, and when the engine is operated in a operating section in which the learning correction is not completed, the device prohibits the calculation of the value of the second air-fuel ratio based on the output of the downstream air-fuel ratio sensor. When the operating condition of the engine changes from the operating section in which the learning correction has completed to the section in which the learning correction does not complete, the center value of the air-fuel ratio correction factor temporarily deviates from the reference value by a large amount, and thereafter, gradually converges to the reference value due to the learning correction. Therefore, if the second air-fuel ratio correction factor is calculated during the period before the learning correction completes, the value of the second air-fuel ratio correction factor also deviates from the value when the learning correction has completed. In this case, there is the possibility that the value of the learning correction factor also deviates from the correct value, i.e., a error occurs in the learning correction. Therefore, the device in the '749 publication prohibits the calculation of the second air-fuel ratio correction factor during the transient period before the learning correction completes, to thereby prevent the error in the learning correction.

However, a problem arises if the calculation of the second air-fuel ratio correction factor is prohibited during the transient period as in the '749 publication. The reason why the second air-fuel ratio correction factor is required is, by compensating for the change in the characteristics of the upstream air-fuel ratio based on the output of the downstream air-fuel ratio sensor, to maintain the air-fuel ratio of the engine accurately at the target air-fuel ratio even when the characteristics of the upstream sensor change due to, for example, deterioration. Therefore, if the calculation of the second air-fuel ratio correction factor is prohibited during the transient period, the changes in the characteristics of the upstream air-fuel ratio sensor are directly reflected to the air-fuel ratio control. Accordingly, the air-fuel ratio of the engine may not be maintained at the target air-fuel ratio during the transient period, and the emission of the engine may increase until the calculation of the second air-fuel ratio correction factor is started after the completion of the learning correction.

SUMMARY OF THE INVENTION

In view of the problems set forth above, the object of the present invention is to provide an air-fuel ratio control device for an internal combustion engine which is capable of compensating for the change in the characteristics of the upstream air-fuel ratio sensor based on the output of the downstream air-fuel ratio sensor even before the learning correction of the air-fuel ratio correction factor completes, without causing an error in the learning correction.

The above-mentioned object is achieved by the air-fuel ratio control device according to the present invention, in which the device comprises a catalytic converter disposed in an exhaust gas passage of an engine an upstream air-fuel ratio sensor disposed in the exhaust gas passage upstream of the catalytic converter for detecting an air-fuel ratio of the exhaust gas upstream of the catalytic converter, a downstream air-fuel ratio sensor disposed in the exhaust passage downstream of the catalytic converter for detecting the air-fuel ratio of the exhaust gas downstream of the catalytic converter, first air-fuel ratio control means for setting the value of a first air-fuel ratio correction factor in accordance with the value of a second air-fuel ratio correction factor and the output of the upstream air-fuel ratio sensor, second air-fuel ratio control means for setting the value of the second air-fuel ratio correction factor in accordance with the output of the downstream air-fuel ratio sensor, learning correction means for performing a learning correction of the first air-fuel ratio correction factor by adjusting the value of a learning correction factor in such a manner that a center value of the fluctuation of the first air-fuel ratio correction factor agrees with a predetermined reference value, fuel supply control means for controlling the amount of fuel supplied to the engine in accordance with the values of the first air-fuel ratio correction factor and the learning correction factor, determining means for determining whether the learning correction by the learning correction means has completed, and transient control means for controlling the second air-fuel ratio control means in such a manner that the rate of change in the value of the second air-fuel ratio correction factor becomes smaller when the learning correction has not completed than after the learning correction has completed.

When the learning correction completes, the value of the second air-fuel ratio correction factor corresponds only to the amount of the change in the characteristics of the upstream air-fuel ratio sensor. However, when the learning correction is not completed, the value of the second air-fuel ratio correction factor reflects the deviation of the air-fuel ratio from the target value. Therefore, when the learning correction of the first air-fuel ratio correction factor is not completed, the value of the second air-fuel ratio correction factor fluctuates largely due to the deviation of the air-fuel ratio. Since the fluctuation of the value of the second air-fuel ratio correction factor is large, if this fluctuating value of the second air-fuel ratio correction factor is used for calculating the value of the first air-fuel ratio correction factor, the fluctuation of the value of the first air-fuel ratio correction factor becomes larger and, thereby the error is caused in the learning correction. According to the present invention, when the learning correction is not completed, the second air-fuel ratio correction factor is controlled so that the rate of the change in the value of the second air-fuel ratio correction factor becomes smaller than that when the learning correction has completed. Therefore, the fluctuation of the value of the second air-fuel ratio correction factor does not become large even it is calculated during the transient period. Accordingly, even if the value of the second air-fuel ratio correction factor is used for calculating the first air-fuel ratio correction factor during this period, the fluctuation of the value of the first air-fuel ratio correction factor also does not become large. Therefore, according to the present invention, it becomes possible to compensate for the change in the characteristics of the upstream air-fuel ratio sensor using the output of the downstream air-fuel ratio sensor even when the learning correction is not completed, without affecting the accuracy of the learning correction.

BRIEF DESCRIPTION OF THE DRAWINGS

The present invention will be better understood from the description as set forth hereinafter, with reference to the accompanying drawings, in which.

DESCRIPTION OF PREFERRED EMBODIMENTS

Embodiments of the present invention will be explained with reference to the accompanying drawings.

Figure 1:
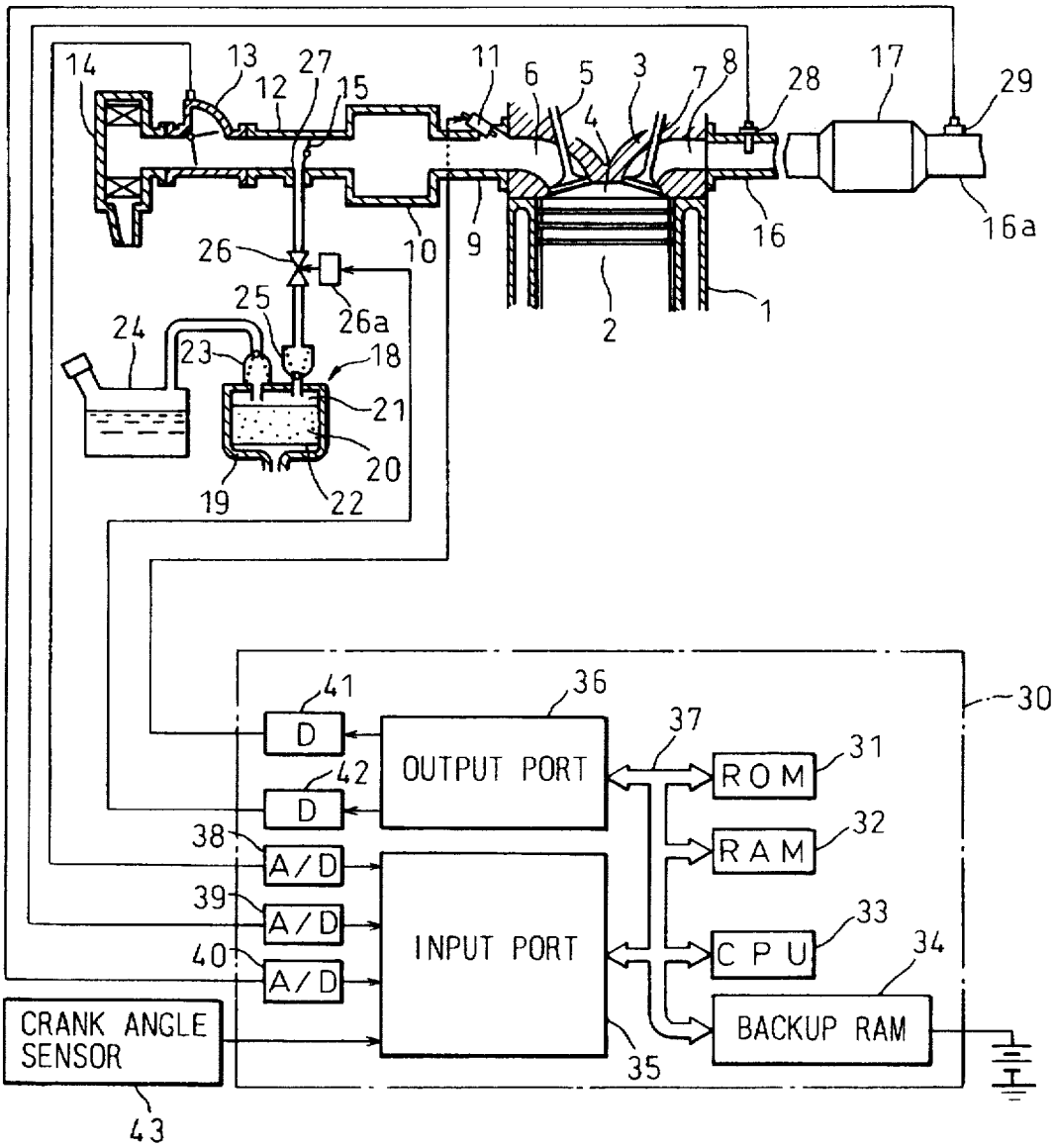
FIG. 1 is a drawing schematically illustrating an embodiment of the air-fuel ratio control device according to the present invention when applied to an automobile engine.

FIG. 1 shows an embodiment of the air-fuel ratio control device according to the present invention when applied to an automobile engine.

In FIG. 1, reference numeral 1 designates an internal combustion engine, numeral 2 designates a piston of the engine 1, and numeral 3 and 4 designate a cylinder head and combustion chamber of the engine, respectively. On the cylinder head 3, an intake port 6 and an exhaust port 8 are provided on each cylinder of the engine (FIG. 1 shows one cylinder only). An intake valve 5 and an exhaust valve 7 are disposed in each of the inlet port 6 and the exhaust port 8, respectively. The intake port 6 of the each cylinder is connected to a surge tank 10 via an intake manifold 9, and the surge tank 10 is further connected to an air-cleaner 14 by an intake air passage 12. Numeral 11 denotes a fuel injection valve which injects pressurized fuel into the intake port 6 in response to a drive signal from a control circuit 30. A throttle valve 15 which takes a degree of opening in response to the amount of depression of an accelerator pedal (not shown) by a driver of the automobile is disposed in the intake air passage 12. In the intake air passage 12, further provided is an airflow meter 13 which generates a signal corresponding to the flow rate of intake air flowing through the intake air passage 12.

The exhaust port 8 is connected to a common exhaust gas passage 16*a* by an exhaust manifold 16. Numeral 17 in FIG. 1 designates a three-way catalytic converter disposed in the common exhaust gas passage 16*a*. The catalytic converter 17 is capable of purifying HC, CO and $NO_x$ components in the exhaust gas simultaneously when the air-fuel ratio of the exhaust gas is near a stoichiometric air-fuel ratio. At the portion of the exhaust gas manifold 16 where the exhaust gases from the respective cylinders join, and at the portion of the common exhaust gas passage 16*a* downstream of the catalytic converter 17, an upstream air-fuel ratio sensor 28 and a downstream air-fuel ratio sensor 29, respectively, are disposed. The air-fuel ratio sensors 28 and 29 in this embodiment are devices such as $O_2$ sensors which detect the concentration of oxygen in the exhaust gas and generate a voltage signal of different level in accordance with whether the air-fuel ratio of the exhaust gas is on a lean side or on a rich side compared to the stoichiometric air-fuel ratio.

Numeral 18 in FIG. 1 designates an evaporative emission control device as a whole. The emission control device 18 in this embodiment includes a canister 19 which adsorbs the fuel vapor from the fuel in the fuel tank 24 of the engine 1. In the canister 19, an atmospheric chamber 22 which communicates with the atmosphere and a fuel vapor chamber 21 are provided. Further, an adsorbent 20 which is, for example, made of active carbon is filled into the canister 19. The fuel vapor chamber 21 is connected to the vapor space above fuel in the fuel tank 24 via a check valve 23, and to the intake air passage 12 through a port 27, a solenoid valve 26 and a check valve 25. The position of the port 27 in the intake air passage 12 is determined in such a manner that the port 27 is positioned upstream of the throttle valve 15 when the valve 15 is in an idle position, and is positioned downstream of the valve 15 when the valve 15 opens at a predetermined degree of opening.

When the solenoid valve 26 is closed, the fuel vapor from the fuel tank 24 flows into the fuel vapor chamber 21 in the canister 19 through the check valve 23 and is adsorbed by the adsorbent 20. In this embodiment, the solenoid valve 26 is usually opened during the operation of the engine. Therefore, when the throttle valve 15 is opened at the predetermined degree of opening, the negative pressure in the intake air passage downstream of the throttle valve 15 is introduced into the fuel vapor chamber 21 through the port 27, the solenoid valve 26 and the check valve 25. This causes the air in the atmospheric chamber 22 to flow into the fuel vapor chamber 21 through the adsorbent 20. When fresh air flows through the adsorbent 20, the fuel vapor adsorbed by the adsorbent 20 is released therefrom and is carried by the air to the fuel vapor 21. The mixture of air and the fuel vapor released from the adsorbent 20, then flows into the intake air passage 12 from the fuel vapor chamber 21 through the check valve 25, the solenoid valve 26 and the port 27. Therefore, when the solenoid valve 26 is opened during the operation of the engine 1, both the fuel vapor released from the adsorbent 20 and the fuel vapor from the fuel tank 24 flow into the intake air passage 12 through the port 27 and are burned in the combustion chamber 4 of the engine 1 (hereinafter, the mixture of air and fuel vapor supplied from the canister 19 to the intake air passage 12 is referred as the "purge gas").

Numeral 30 in FIG. 1 designates a control circuit of the engine 1. The control circuit 30 may, for example, consist of a microcomputer of conventional type which comprises a ROM (read-only memory) 31, a RAM (random access memory) 32, a CPU (microprocessor) 33, a backup RAM 34, an input port 35 and an output port 36, all connected one another by a bi-directional bus 37. The backup RAM 34 is directly connected to a battery of the engine 1 and is capable of sustaining its memory content even when the main switch of the engine 1 is turned off. The control circuit 30 performs a first and a second air-fuel ratio control based on the outputs of the $O_2$ sensors 28 and 29, as explained later. Further, the control circuit 30 calculates the feedback learning correction factor and the fuel vapor learning correction factor in accordance with a first air-fuel ratio correction factor calculated by the first air-fuel ratio control, and further, controls the fuel injection amount in accordance with the engine load condition and the first air-fuel ratio correction factor, the feedback learning correction factor and the fuel vapor learning correction factor. Separate from the above air-fuel ratio control, the control circuit 30 controls the amount of the purge gas supplied to the engine in accordance with the engine operating conditions. Namely, control circuit 30 determines a purge ratio which is the ratio of the flow amounts of the purge gas and intake air supplied to the engine in accordance with the engine operating conditions. Further, the control circuit 30 controls the degree of opening of the purge control valve 26 in accordance with the flow amount of the intake air detected by the airflow meter 3 in such a manner that the above-noted purge ratio is obtained.

To perform these types of control, signals corresponding to the flow rate of the intake air and the air-fuel ratio of the exhaust gas are fed to the input port 35 from the airflow meter 13 and the $O_2$ sensors 28, 29 via respective A/D converters 38, 39 and 40. Further, a pulse signal representing an engine rotational speed is fed to the input port 35 from a crank angle sensor 43 disposed at a crankshaft (not shown) of the engine 1. The output port 36 of the control circuit 30 is connected to the fuel injection valve 11 and an actuator 26*a* of the solenoid valve 26 through the respective drive circuits 41 and 42, to control an opening period, i.e., the fuel injection amount of the fuel injection valve 11 and the degree of opening of the solenoid valve 26.

The fuel injection amount TAU is calculated by the following formula in this embodiment.

$$TAU=TP\times\{FAF+(1.0-KG)+(1-FGPG\times PGR)\}\times T_1+T_2 \quad (1)$$

TP in the above formula represents a basic fuel injection amount which is a fuel amount to make the operating air-fuel ratio of the engine 1 stoichiometric. The basic fuel injection amount TP is determined in advance by, for example, experiment using the actual engine, and stored in the ROM 31 as a function of an engine load (for example, a function of the ratio of the amount of the intake air per one revolution of the engine, Q/N). PGR is a purge ratio which is a ratio between the amount of the purge gas supplied to the engine from the canister 19 and the amount of the intake air, as explained above, and $T_1$ and $T_2$ are constants determined by the operating conditions (such as the temperature of the engine). FAF, KG and FGPG represent an air-fuel ratio correction factor (in this embodiment, the air-fuel ratio correction factor corresponds to the first air-fuel ratio correction factor in the claims), a feedback learning correction factor and a fuel vapor learning correction factor, respectively.

FAF, KG and FGPG will be explained hereinafter with reference to FIGS. 2 through 8.

Figure 2:
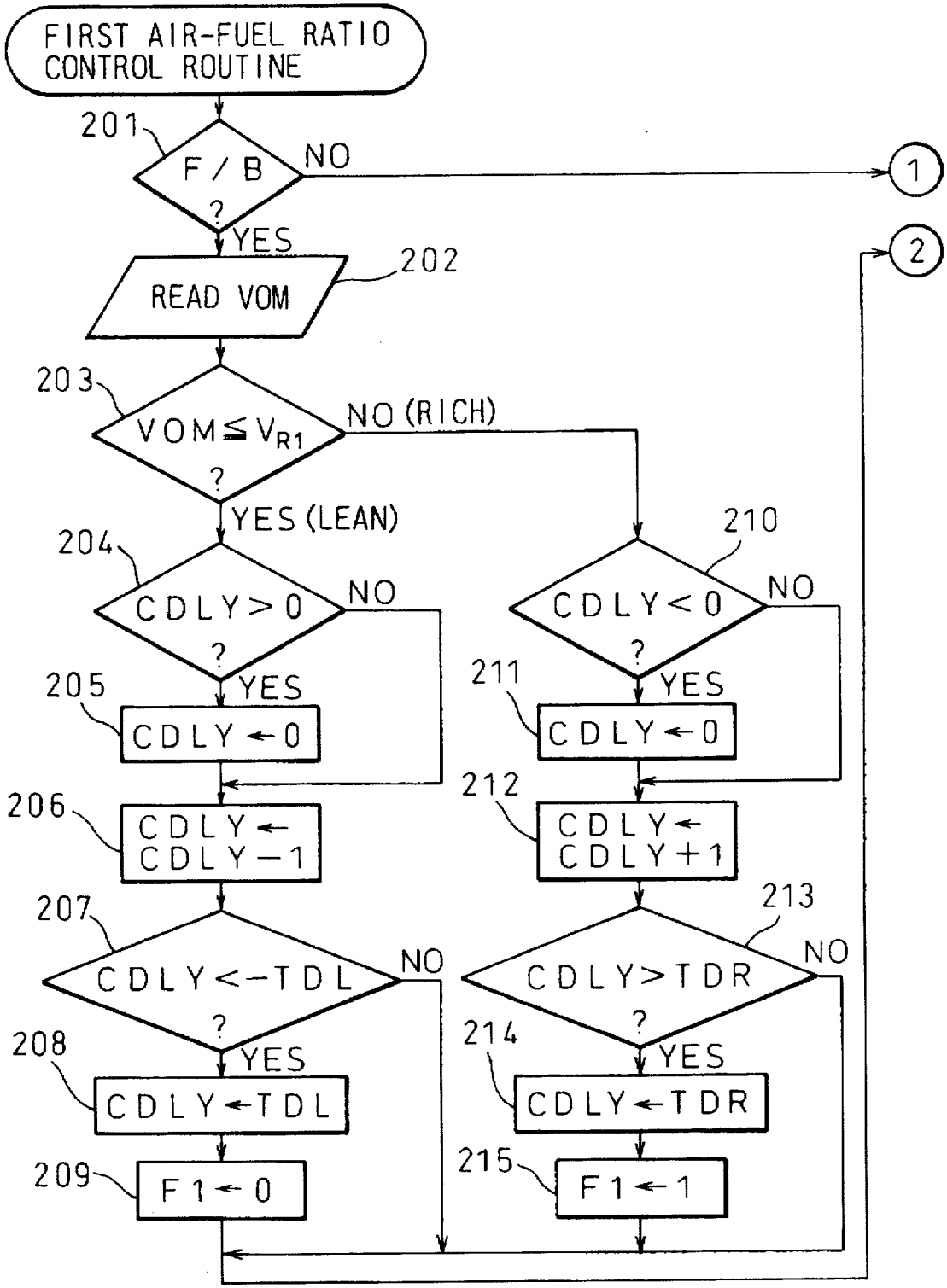
FIGS. 2 and 3 show a flowchart illustrating a first air-fuel ratio control based on the output of the upstream air-fuel ratio sensor.
Figure 3:
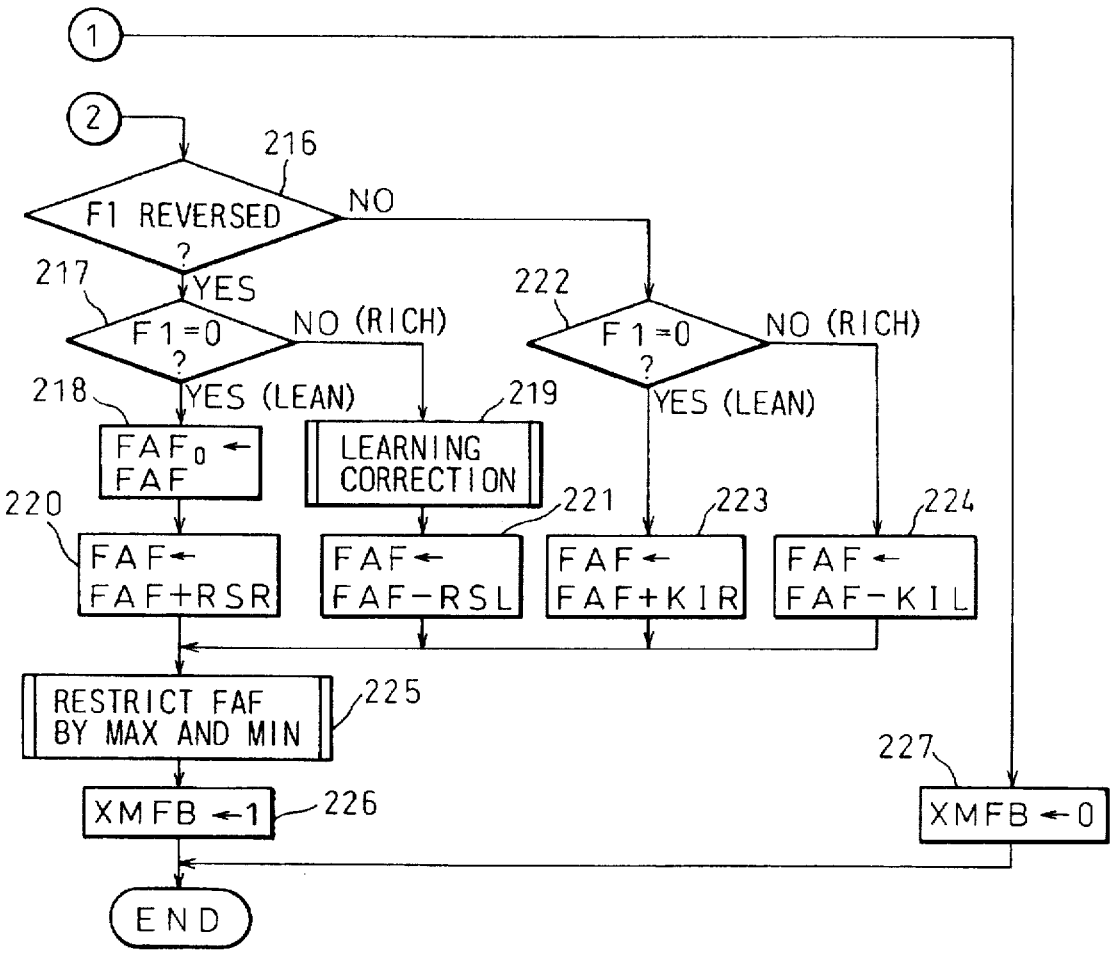
Figure 4:
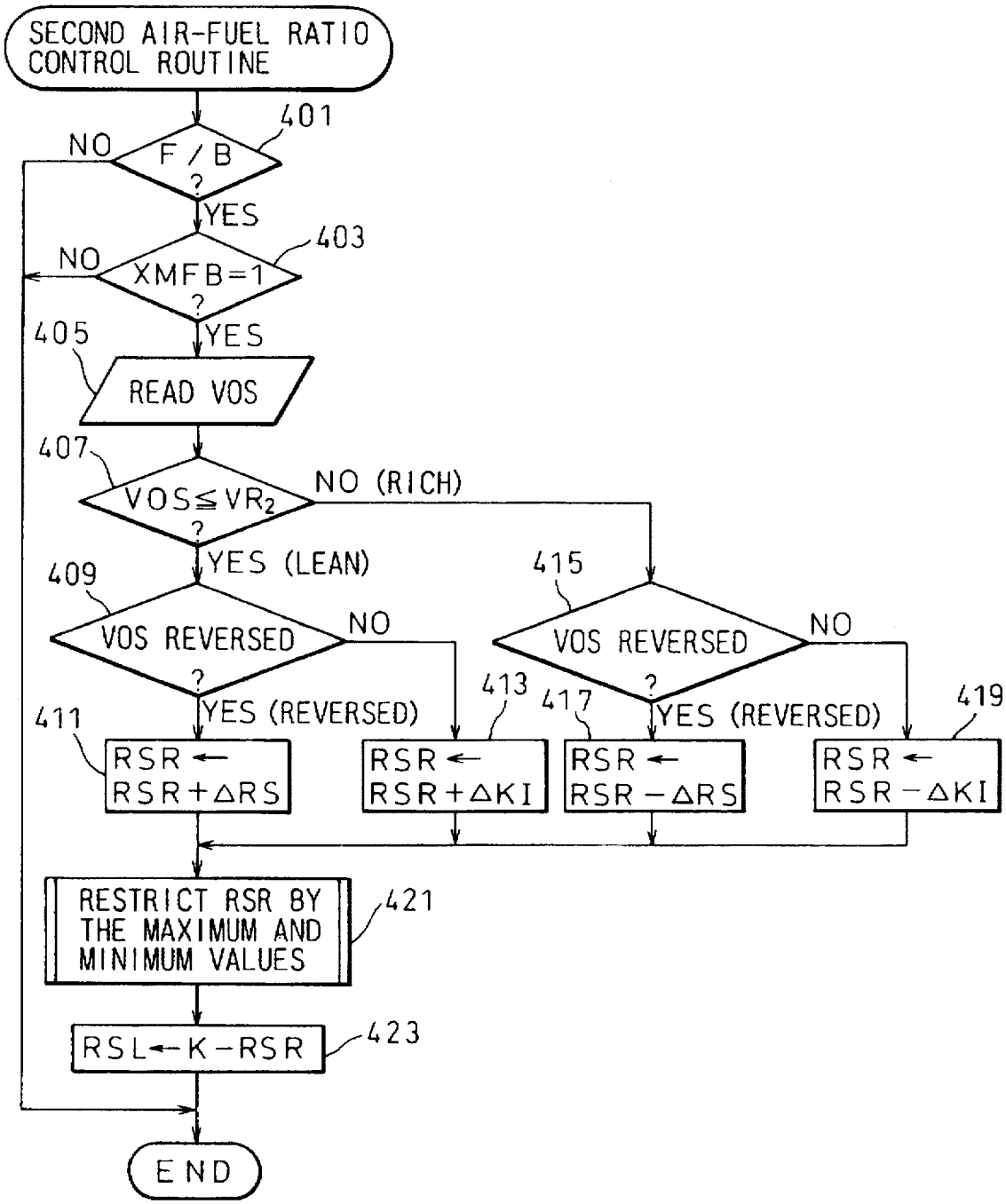
Fig. 4 PRIOR ART
FIG. 4 show a flowchart illustrating a conventional second air-fuel ratio control based on the output of the downstream air-fuel ratio sensor.

FIGS. 2 through 4 show flowcharts illustrating routines for calculating the air-fuel ratio correction factor FAF. The value of FAF is calculated by a first air-fuel ratio control routine (FIGS. 2 and 3) based on the output of the upstream air-fuel ratio sensor 28. Further, the values of second air-fuel ratio correction factors (RSR, PSL) used for the calculation of FAF is determined by the second air-fuel ratio control routine (FIG. 4) in accordance with the output of the downstream air-fuel ratio sensor 29. As explained before, since the change in the characteristics of the upstream air-fuel ratio sensor 28 is compensated by the second air-fuel ratio correction factors determined by the output of the downstream air-fuel ratio sensor 29, the accuracy of the air-fuel ratio control is largely improved.

FIGS. 2 and 3 show a flowchart of the first air-fuel ratio control routine. This routine is executed by the control circuit 30 at predetermined regular intervals. In the routine in FIGS. 2 and 3, the value of the air-fuel ratio correction factor FAF is decreased when an output voltage signal VOM of the $O_2$ sensor 28 is higher than a reference voltage $V_{R1}$ (i.e., $VOM>V_{R1}$), and is increased when the output VOM is lower than or equal to the reference voltage $V_{R1}$ (i.e., $VOM\leqq V_{R1}$). The reference voltage $V_{R1}$ is an output voltage of the $O_2$ sensor 28 which corresponds to the stoichiometric air-fuel ratio. The $O_2$ sensor 28 outputs voltage signal of, for example, 0.9V when the air-fuel ratio of the exhaust gas is on a rich side compared to the stoichiometric air-fuel ratio, and of 0.1V, for example, when the air-fuel ratio of the exhaust gas is on a lean side compared to the stoichiometric air-fuel ratio. The reference voltage $V_{R1}$ of the $O_2$ sensor is set at 0.45V, for example, in this embodiment. By adjusting the value of FAF in accordance with the air-fuel ratio of the exhaust gas, the air-fuel ratio of the engine is maintained near the stoichiometric air-fuel ratio even if the characteristics of the elements in the fuel supply system such as the airflow meter 13 and the fuel injection valve 11 deviate from the design characteristics by a certain amount.

The flowchart in FIGS. 2 and 3 is explained in brief. When the routine starts in FIG. 2, at step 201, it is determined whether the conditions for performing the air-fuel ratio feedback control are satisfied. The conditions determined at step 201 are, for example, whether the $O_2$ sensor 28 is activated, whether the engine 1 is warmed up and whether a predetermined time has elapsed since a fuel cut operation (in which the fuel injection is interrupted) such as in an engine brake operation is terminated. If these conditions are satisfied at step 201, the routine proceeds to steps 202 and thereafter, to calculate the value of FAF. If any of the conditions is not satisfied, the routine terminates after setting the value of a flag X at 0 at step 227 in FIG. 3. XMFB is a flag for representing whether the first air-fuel ratio control is being performed, and XMFB=0 means that the first air-fuel ratio control has been interrupted.

Steps 202 through 215 in FIG. 2 are steps for determining air-fuel ratio of the exhaust gas. F1 in steps 209 and 215 is a flag representing whether the air-fuel ratio of the exhaust gas is on a rich side (F1=1) or on a lean side (F1=0) compared to the stoichiometric air-fuel ratio. The value of F1 is switched (reversed) from 0 to 1 (a lean condition to a rich condition) when the $O_2$ sensor 28 continuously outputs a rich signal (i.e., $VOM>V_{R1}$) for more than a predetermined time period (TDR) (steps 203 and 204 through 209). Similarly, the value of F1 is switched (reversed) from 1 to 0 (a rich condition to a lean condition) when the $O_2$ sensor 28 continuously outputs a lean signal ($VOM\leqq V_{R1}$) for more than a predetermined time period (TDL) (steps 203 and 210 through 215). CDLY in the flowchart is a counter for determining the timing for reversing the value of the flag F1.

At steps 216 through 224 in FIG. 3, the value of FAF is adjusted in accordance with the value of the flag F1 set by the steps explained above. At step 216, it is determined whether the air-fuel ratio of the exhaust gas is reversed (i.e., changed from a rich air-fuel ratio to a lean air-fuel ratio, or vice versa) since the routine was last executed, by determining whether the value of F1 changed from 1 to 0 or 0 to 1). If the value of F1 changed from 1 to 0 (a rich condition to a lean condition) since the routine was last executed (steps 216 and 217), the value of FAF is increased step-wise by a relatively large amount RSR (step 220), and if the value of F1 changed from 0 to 1 (a lean condition to a rich condition) since the routine was last executed (steps 216 and 217), the value of FAF is decreased step-wise by a relatively large amount RSL (step 241). If the value of F1 did not change since the routine was last executed, and if the value of F1 is 0, the value of FAF is increased by a relatively small value KIR every time when the routine executed, as long as the value of F1 is 0 (steps 216, 222 and 223). Similarly, if the value of F1 did not change, and if the value of F1 is 1, the value of FAF is decreased by a relatively small value KIL every time when the routine executed (steps 216, 222 and 224). Namely, when the value of F1 did not reverse, the value of FAF is gradually increased or decreased in accordance with whether the air-fuel ratio of exhaust gas (F1) is rich or lean. Further, the value of the FAF is restricted by the maximum value MAX (for example, MAX=1.2) and the minimum value (for example, MIN=0.8) to keep the value of FAF within the range determined by the values of MAX and MIN (step 225). Then, the routine terminates this time, after setting the value of the flag XMFB at 1 at step 226.

Figure 8:
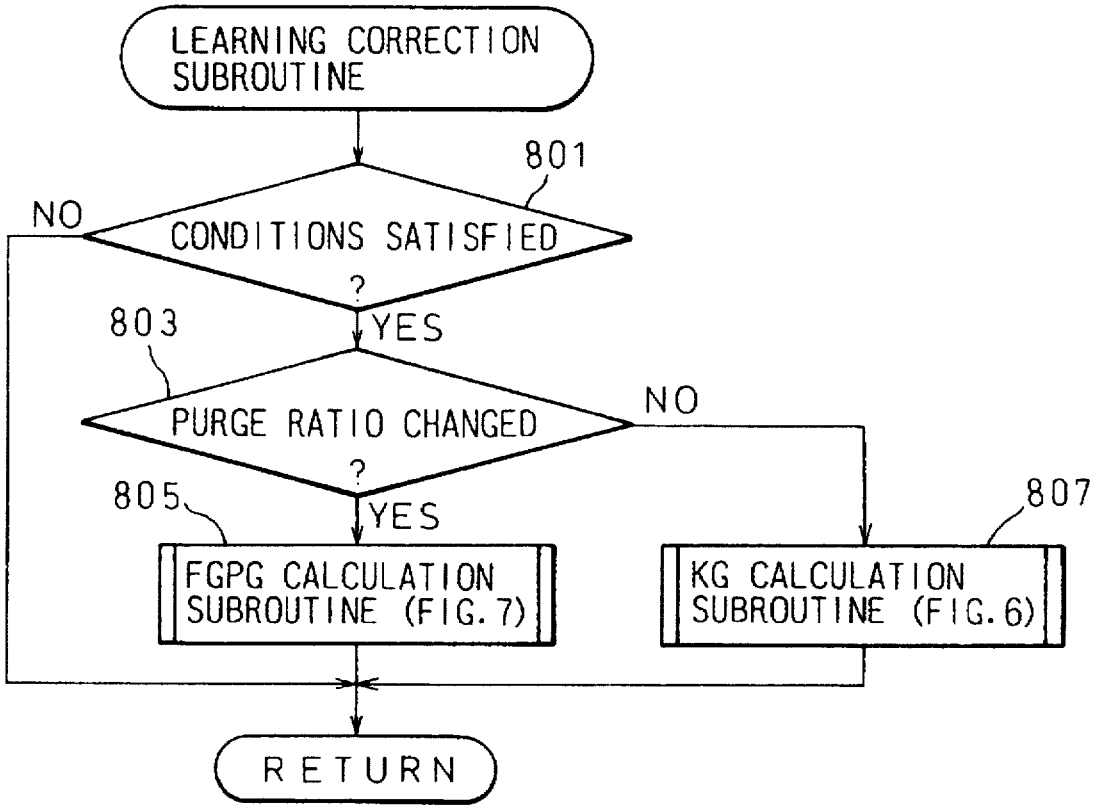
FIG. 8 shows a flowchart illustrating a subroutine for learning correction.

Further, if the value of FAF changed from 0 to 1 since the routine was last executed, the value of FAF immediately before it is increased by RSR is stored in the RAM 32 as $FAF_0$ at step 218. If the value of FAF changed from 1 to 0 since the routine was last executed, the learning correction subroutines in FIG. 8 are performed to adjust the values of the feedback learning correction factor KG and the fuel vapor learning correction factor FGPG (step 219). Namely, the values of correction factors KG and FGPG are adjusted every time when the air-fuel ratio of the exhaust gas (F1) is changed from a lean air-fuel ratio to a rich air-fuel ratio.

Next a conventional second air-fuel ratio control is explained before explaining the second air-fuel ratio control of the present embodiment. FIG. 4 shows a typical flowchart of the conventional second air-fuel ratio control routine. In this routine, values of second air-fuel ratio correction factors RSR and RSL are calculated in accordance with the output of the downstream $O_2$ sensor 29. This routine is normally processed at intervals longer than that of the first air-fuel ratio control routine.

In this routine, the output voltage VOS of the downstream $O_2$ sensor 29 is compared with a reference voltage $V_{R2}$, and the amounts RSR and RSL used in the first air-fuel ratio control routine are changed in accordance with whether VOS is larger than $V_{R2}$. The reference voltage $V_{R2}$ is an output voltage of the downstream $O_2$ sensor 29 which corresponds to the stoichiometric air-fuel ratio. When $VOS>V_{R2}$, i.e., when the air-fuel ratio of the exhaust gas downstream of the catalytic converter is rich compared to the stoichiometric air-fuel ratio, the amount RSR is decreased, and at the same time, the amount RSL is increased. Similarly, when $VOS\leqq V_{R2}$, i.e., when the air-fuel ratio of the exhaust gas downstream of the catalytic converter is lean compared to the stoichiometric, the amount RSR is increased and the amount RSL is decreased simultaneously. When the amount RSR becomes larger, the value of FAF also becomes larger and, thereby the fuel injection amount becomes larger as shown by the formula (1) explained before. Contrary to this, when the amount RSL becomes larger, the value of FAF becomes smaller, and the fuel injection amount becomes smaller. Therefore, even when the output characteristics of the upstream 28 changes, i.e., even when the output voltage of the upstream $O_2$ sensor corresponding to the stoichiometric air-fuel ratio deviates from the reference voltage $V_{R1}$, this deviation is corrected by the change in the values of RSR and RSL and, thereby the air-fuel ratio of the engine is maintained at the stoichiometric air-fuel ratio.

The flowchart of the conventional second air-fuel ratio control routine FIG. 4 is explained hereinafter in brief.

In FIG. 4, at steps 401 and 403, it is determined whether the conditions for performing the second air-fuel ratio control is satisfied. The conditions determined at step 401 are similar to the conditions determined at step 201 in FIG. 2. However, in this routine, it is determined at step 403, whether the first air-fuel ratio control routine is being carried out, based on the value of the flag XMFB. If the conditions in step 401 are satisfied, and the first air-fuel ratio control routine is being carried out, the values of RSR and RSL are adjusted at the steps 405 through 423. If any of conditions in step 401 is not satisfied, or if the first air-fuel ratio control routine is being interrupted, the routine terminates immediately.

At steps 405 through 423, the value of RSR is increased or decreased in accordance with the output VOS of the downstream $O_2$ sensor 29 in a somewhat similar manner as FAF in the routine in FIGS. 2 and 3. Namely, at step 405, the output VOS of the downstream $O_2$ sensor 29 is read through the A/D converter. At step 407, VOS is compared with the reference voltage $V_{R2}$, to thereby determine whether the air-fuel ratio of the exhaust gas downstream of the catalytic converter is rich or lean. Further, at steps 409 and 415, it is determined whether the air-fuel ratio of the exhaust gas downstream of the catalytic converter is reversed (from rich to lean, or from lean to rich) since the routine was last executed. The value of RSR, is increased step-wise by an amount ΔRS when the air-fuel ratio of the exhaust gas is reversed from rich to lean (steps 407, 409 and 411), and after that, the value of RSR is increased gradually by an amount ΔKI at a time as long as the air-fuel ratio of the exhaust gas downstream of the catalytic converter is lean (steps 407, 409 and 413). Further, the value of RSR is decreased step-wise by the amount ΔRS when the air-fuel ratio of the exhaust gas is reversed from lean to rich (steps 407, 415 and 417), and after that, the value of RSR, is decreased gradually by an amount ΔKI at a time as long as the air-fuel ratio of the exhaust gas downstream of the catalytic converter is rich (steps 407, 415 and 419). At step 421, the value of RSR adjusted by the above-explained steps is restricted by the predetermined maximum and minimum values. The value of RSL is, then, calculated at step 423 by RSR=K−RSR (K is a predetermined constant, and K is usually set at about 0.1).

As explained above, in the conventional second air-fuel ratio control, when the downstream $O_2$ sensor outputs a rich air-fuel ratio signal (i.e., $VOS>V_{R2}$), RSR is decreased and RSL is increased simultaneously, and when the downstream $O_2$ sensor outputs a lean air-fuel ratio signal (i.e., $VOS\leqq V_{R2}$), RSR is increased and RSL is decreased simultaneously.

Figure 5:
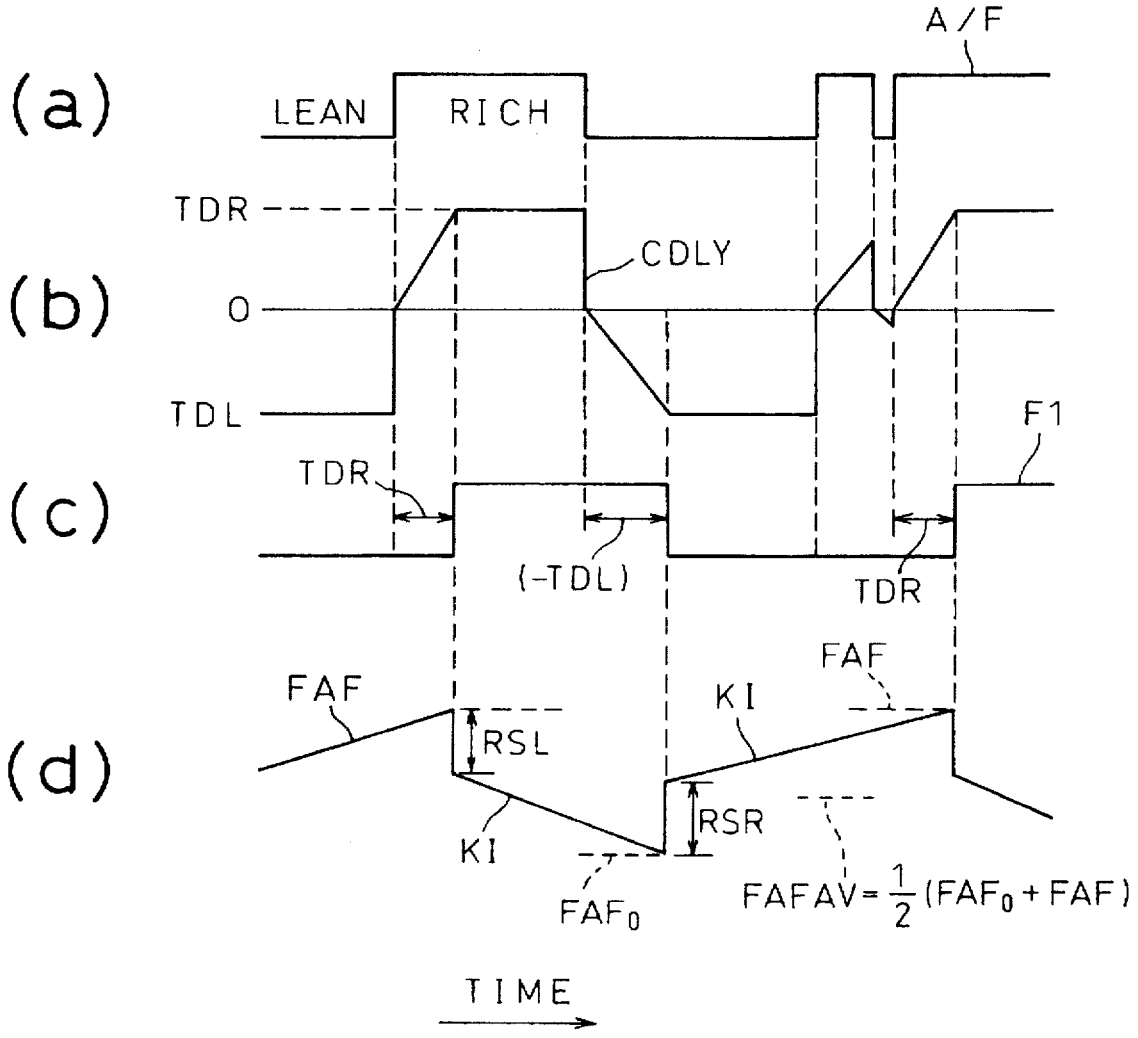
FIG. 5 shows a timing diagram explaining the air-fuel ratio control of FIGS. 2 through 4.

FIG. 5 shows changes in the values of the counter CDLY (curve (b) in FIG. 5), the flag F1 (curve (c) in FIG. 5) and FAF (curve (d) in FIG. 5) in accordance with the change in the air-fuel ratio (A/F) of the engine (curve (a) in FIG. 5) when the air-fuel ratio is controlled by the routines in FIGS. 2, 3 and 4. As shown in FIG. 5, the value of FAF fluctuates around a center value (FAFAV in FIG. 5, for example) corresponding to the stoichiometric air-fuel ratio. Usually, in the ideal condition in which the characteristics of the elements in the fuel supply system such as the airflow meter and fuel injection valve agree with the design characteristics, the air-fuel ratio correction factor FAF fluctuates around the center value of 1.0, and the value 1.0 corresponds to the stoichiometric air-fuel ratio. In the actual operation of the engine, if the characteristics of the elements in the fuel supply system deviate from the design characteristics due to a lapse of time or inherent deviations of the individual elements, the value of FAF corresponding to the stoichiometric air-fuel ratio also deviates from 1.0, and the FAF becomes fluctuate around the center value which deviates from 1.0. Further, when the purge gas from the canister 19 is supplied to the engine, since the total amount of the fuel supplied to the engine increases, the center value of FAF also deviates from 1.0. In this case, since the deviations of the characteristics of elements in the fuel supply system and fuel vapor supplied from the canister are compensated for by the change in the value of FAF, the fuel injection amount is always maintained at the value required for obtaining the stoichiometric air-fuel ratio even if the characteristics of the elements deviate from the designed value.

However, as explained in FIG. 3, the change in the value of FAF is restricted by the maximum value MAX and the minimum value MIN as explained in FIG. 3 at step 225. Therefore, if the center value of FAF deviates from 1.0, the controllable air-fuel ratio range becomes narrow. For example, if FAF fluctuates around the center value 1.1, since the value of FAF is restricted by the maximum value 1.2 (MAX), the value of FAF can change in the range between 1.1 and 1.2 on a lean air-fuel ratio side, and a lean air-fuel ratio which requires the value of FAF larger than 1.2 for correcting the air-fuel ratio to the stoichiometric air-fuel ratio cannot be corrected by FAF.

In order to prevent such problems, FAF is corrected by learning correction using the feedback learning correction factor KG and the fuel vapor learning correction factor FGPG, thereby the center value of FAF is always maintained at around the reference value 1.0. Next, the learning correction of FAF is explained.

In this embodiment, the operating range of the engine is divided into a plural sections in accordance with the amount of intake air, and the learning correction by the feedback correction factor KG is performed separately for each operating section. The reason why the learning correction by KG is performed separately for the each operating sections is, since the amount of the deviation of the characteristics of the airflow meter from the design characteristics is different in accordance with the amount of airflow, it is preferable to perform the learning correction separately for the respective airflow range.

The fuel vapor correction factor FGPG is determined in accordance with the purge ratio when the purge gas is supplied to the engine, to have the center value of FAF agree with the reference value regardless of the change in the amount of the purge gas.

Figure 6:
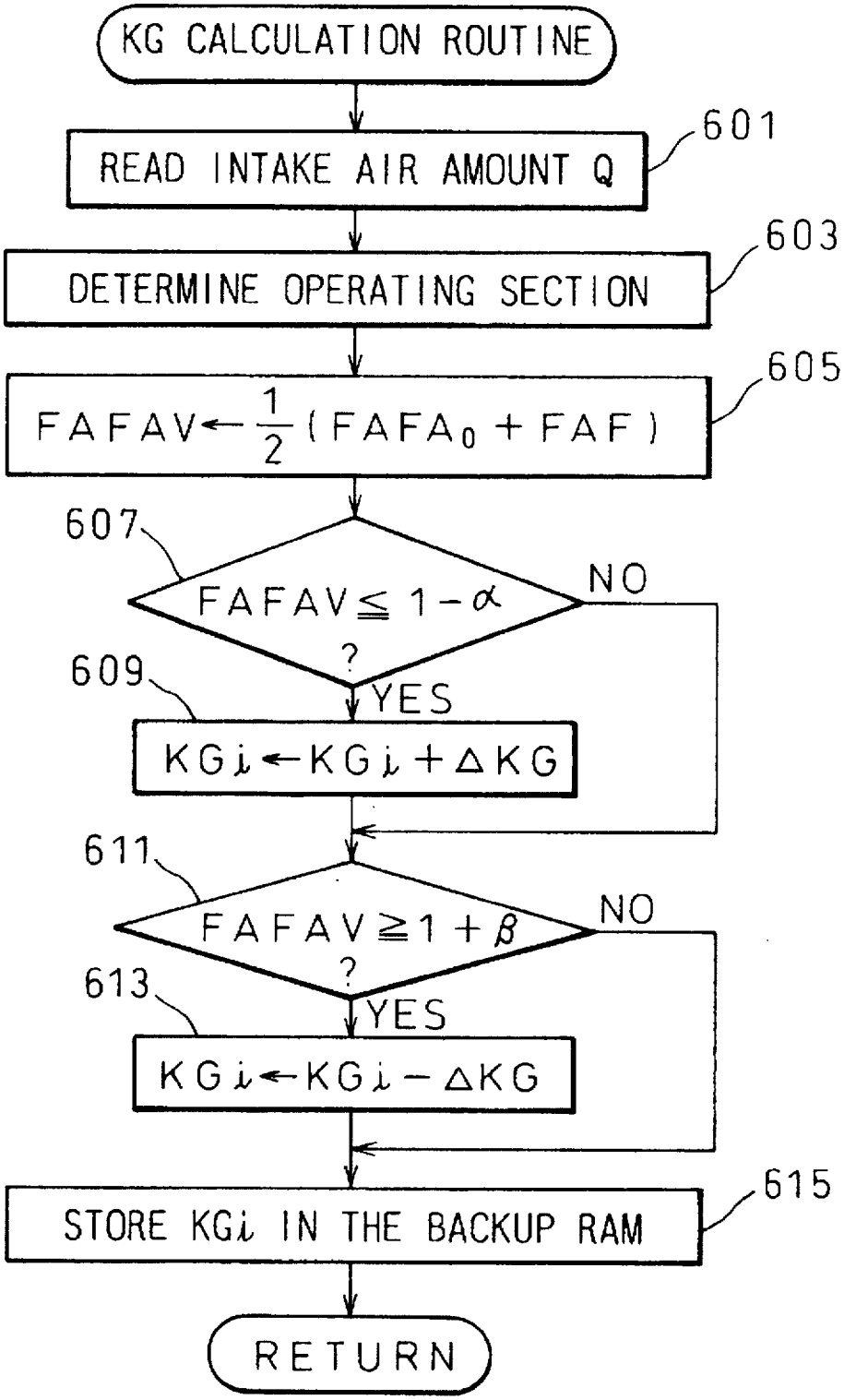
FIG. 6 shows a flowchart illustrating a subroutine for calculating a feedback learning correction factor.

FIG. 6 shows a flowchart illustrating a subroutine for calculating the feedback learning correction factor KG in this embodiment. This subroutine is executed when the conditions explained later are satisfied. In FIG. 6, the amount Q of intake air is read from the airflow meter 13 through the A/D converter, and at step 603, the current operating section is determined from the intake air amount Q. In this embodiment, the range of the intake air amount during the engine operation is divided into plural sections (for example, divided into n sections) and the value of the feedback learning correction factor KG is determined separately for each of n sections. Accordingly, when the current operating section of the engine is determined at step 603, only the feedback learning correction factor of that section is calculated in the following steps. For example, if the current operating section is i-th section, only the feedback learning correction factor $KG_i$ is calculated.

At step 605, FAFAV is calculated. FAFAV is an arithmetic mean of $FAF_O$, which is the value of FAF immediately before the value of F1 changed from 0 to 1 (step 218 in FIG. 3 and the curve (d) in FIG. 5), and the value of FAF immediately after the value of F1 has changed from 1 to 0 (step 219 in FIG. 3), i.e., $FAFAV=(FAF_O+FAF)/2$. In the subroutine, it is assumed that FAFAV corresponds to the stoichiometric air-fuel ratio, and the value of $KG_i$ is adjusted in accordance with the difference between the value of FAFAV and the reference value 1.0.

In the subroutine of FIG. 6, when the FAFAV is smaller than 1.0 by more than a positive value α, i.e., when $FAFAV \leqq (1-\alpha)$, the value of the feedback learning correction factor $KG_i$ is increased by a predetermined value ΔKG. In contrary to this, if FAFAV is larger than 1.0 by more than a positive value β, i.e., when $FAFAV \geqq (1+\beta)$, the value of $KG_i$ is decreased by the amount ΔKG. When FAFAV is between these values, i.e., when $(1-\alpha)<FAFAV<(1+\beta)$, the value of FAFAV is unchanged (steps 607 through 613). Further, the value of $KG_i$ calculated by the above steps is stored in the backup RAM 34 of the control circuit 30 at step 615.

In the above subroutine, for example, if the value of FAF increases and the value of FAFAV becomes larger than the reference value 1.0 by more than the amount β, the value of KG is decreased. Therefore, since the term (1−KG) in the calculation formula (1) of the fuel injection amount TAU increases, the value of FAF is thereby decreased by the routine in FIG. 2 and approaches the reference value 1.0.

Figure 7:
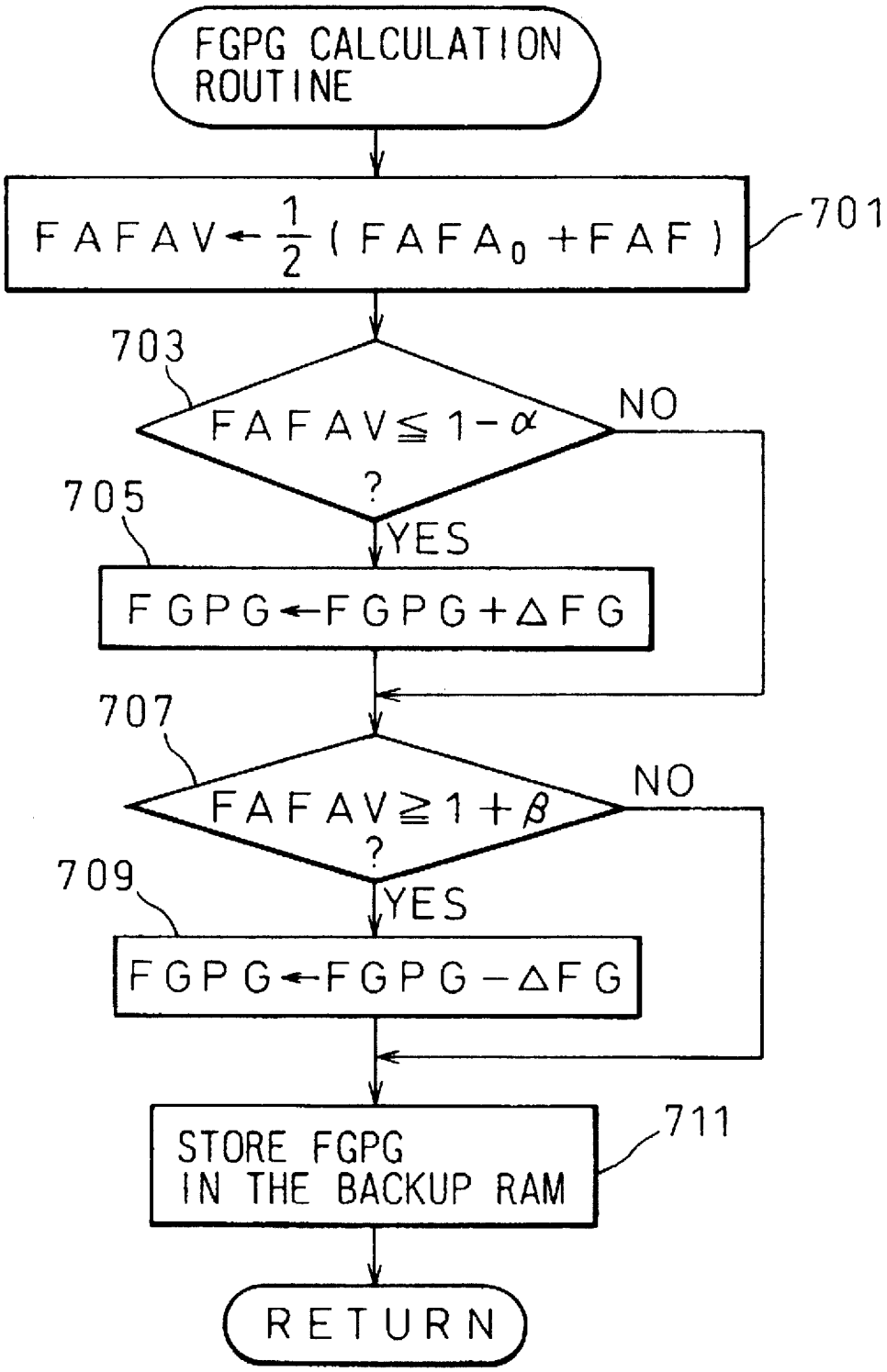
FIG. 7 shows a flowchart illustrating a subroutine for calculating a fuel vapor learning correction factor.

FIG. 7 shows a flowchart of the subroutine for calculating the value of the fuel vapor learning correction factor FGPG. In this subroutine, the value of FGPG is increased or decreased by an amount ΔFG at a time in accordance with the difference between FAFAV and the reference value 1.0 in the same manner as KG. Steps 701 through 711 in FIG. 7 are similar to steps 605 through 615 in FIG. 6. Therefore, a detailed explanation is not repeated here.

FIG. 8 is a learning correction subroutine executed at step 219 in FIG. 3. In this subroutine, the calculation of the feedback learning correction factor KG (FIG. 6) or the calculation of the feedback learning correction factor FGPG (FIG. 7) is executed in accordance with whether the purge ratio of the engine has changed.

In FIG. 8, at step 801, it is determined whether the conditions for performing the learning correction (i.e., the conditions for adjusting the value of KG and FGPG) are satisfied. The conditions determined at step 801 are, for example, the first and the second air-fuel ratio control are both being carried out and the engine is warmed up. If any of these conditions is not satisfied, the routine terminates immediately without adjusting the value of KG and FGPG. If the conditions in step 801 are all satisfied, the routine proceeds to step 803 which determines whether the purge ratio (i.e., the degree of opening of the purge control valve 26) has changed more than a predetermined amount since the subroutine was last executed.

If the purge ratio has changed more than a predetermined value, at step 803, since it is considered that the deviation of FAFAV from the reference value is caused by the change in the amount of the purge gas from the canister 19, the calculation subroutine of the fuel vapor learning correction factor FGPG (FIG. 7) is performed at step 807. In contrast to this, if the purge ratio has not changed since the subroutine was last executed, the calculation subroutine of the feedback learning correction factor KG is performed at step 805, since it is considered that the deviation of FAFAV is caused by the change in the characteristics of the elements in the fuel supply system.

By adjusting the value of KG and FGPG as explained above, the air-fuel ratio correction factor FAF fluctuates around the reference value regardless of the changes in the characteristics of the elements and the amount of the purge gas.

However, since the value of KG is calculated separately for each of the operating sections in this embodiment, if the operating sections is changed from one section to another, problems may arise. In the actual operation of the engine, the learning correction of FAF does not proceed simultaneously in all of the operating sections. Namely, the sections in which the learning correction is completed (i.e., the value of $KG_i$ reaches a value required for maintaining FAFAV at the reference value) and the sections in which the learning correction is not completed (FAFAV still deviates from the center value) exist simultaneously in the actual operation of the engine. Therefore, if the intake air amount Q changes during the operation of the engine from the section in which the learning correction is completed to the section in which the learning correction is not completed, FAFAV deviates largely from the reference value. In this condition, since the FAFAV deviates largely from the reference value, the value of FAF, as a whole, deviates from the reference value, and the values of RSR and RSL are changed rapidly by the second air-fuel ratio control to make the value of FAF approach the reference value. This causes the values of RSR and RSL to fluctuate. Due to the fluctuations of RSR and RSL, the fluctuation of the value of FAF becomes irregular and asymmetric. When this occurs, the value of FAFAV does not represent the center value of the fluctuation of FAF any more and, therefore, the deviation of FAFAV from the reference value does not correspond to the amount of the deviation of the characteristics of the elements from the design characteristics. Accordingly, if the learning correction by KG is carried out in this condition, the value of KG is incorrectly adjusted, i.e., an error in the learning correction occurs.

If the values of RSR and RSL is forcibly fixed in this transient condition, i.e., if the second air-fuel ratio control is interrupted as in the related art, the fluctuation of FAFAV may become small. However, if the second air-fuel ratio control is interrupted, the value of FAF comes to reflect the deviation of the characteristics of the upstream $O_2$ sensor directly and, thereby, the air-fuel ratio of the engine deviates from the target air-fuel ratio.

In this embodiment, therefore, the second air-fuel ratio control is not interrupted even when the intake air amount Q changes from the operating section in which the learning control is completed to the section in which the learning control is not completed. Instead, in this embodiment, transient control is performed when the operating section is changed due to the change in the intake air amount Q so that the fluctuation of the values of RSR and RSL becomes small. By suppressing the fluctuations of RSR and RSL, the irregularity in the fluctuations of FAF becomes smaller and, thereby FAFAV comes to represent the center value of the fluctuation of FAF. Accordingly, an error in the learning correction due to the change in the operating section does not occur.

Figure 9:
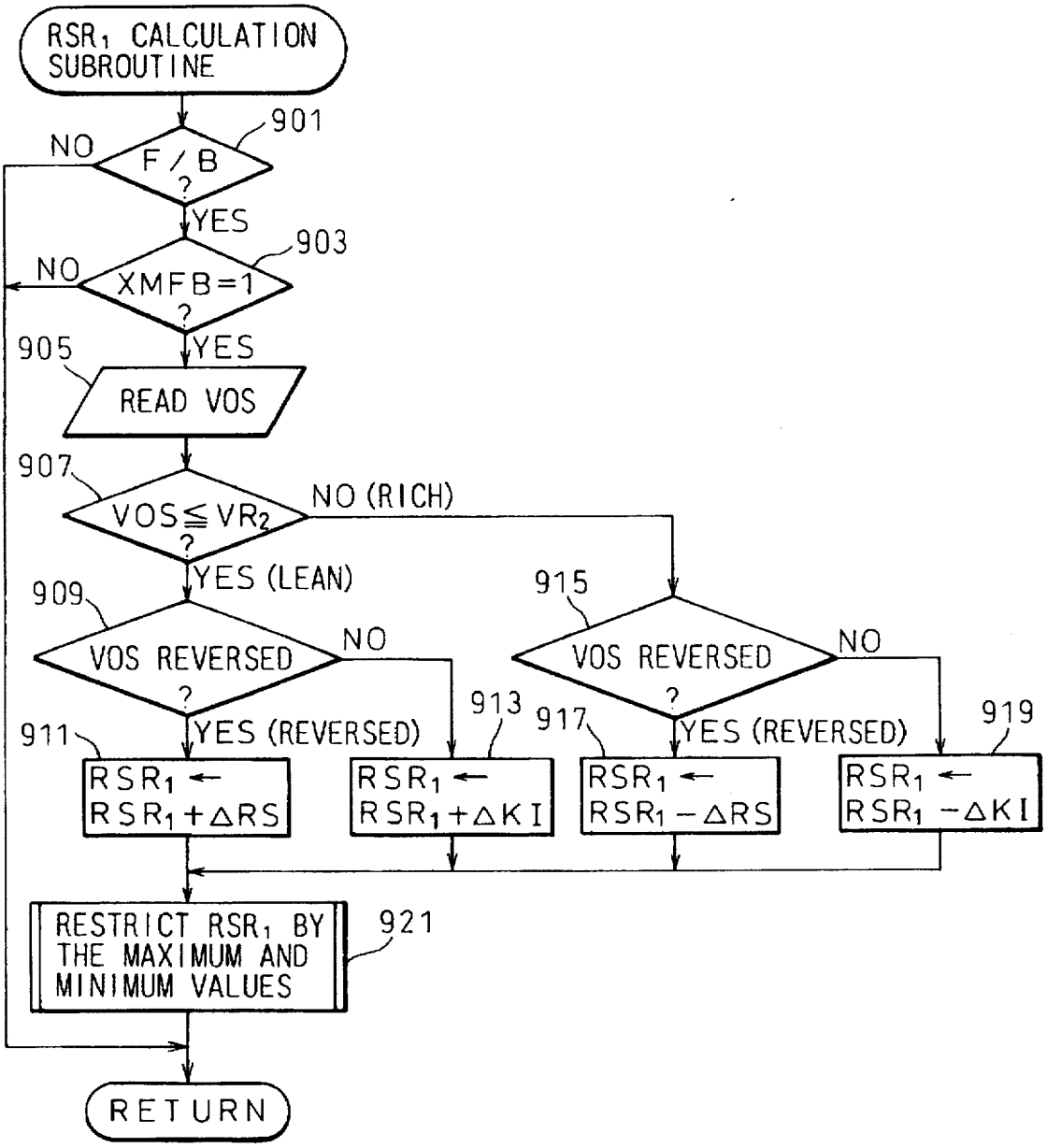
FIG. 9 shows a flowchart illustrating a routine for calculating a first air-fuel ratio sub-correction factor.
Figure 10:
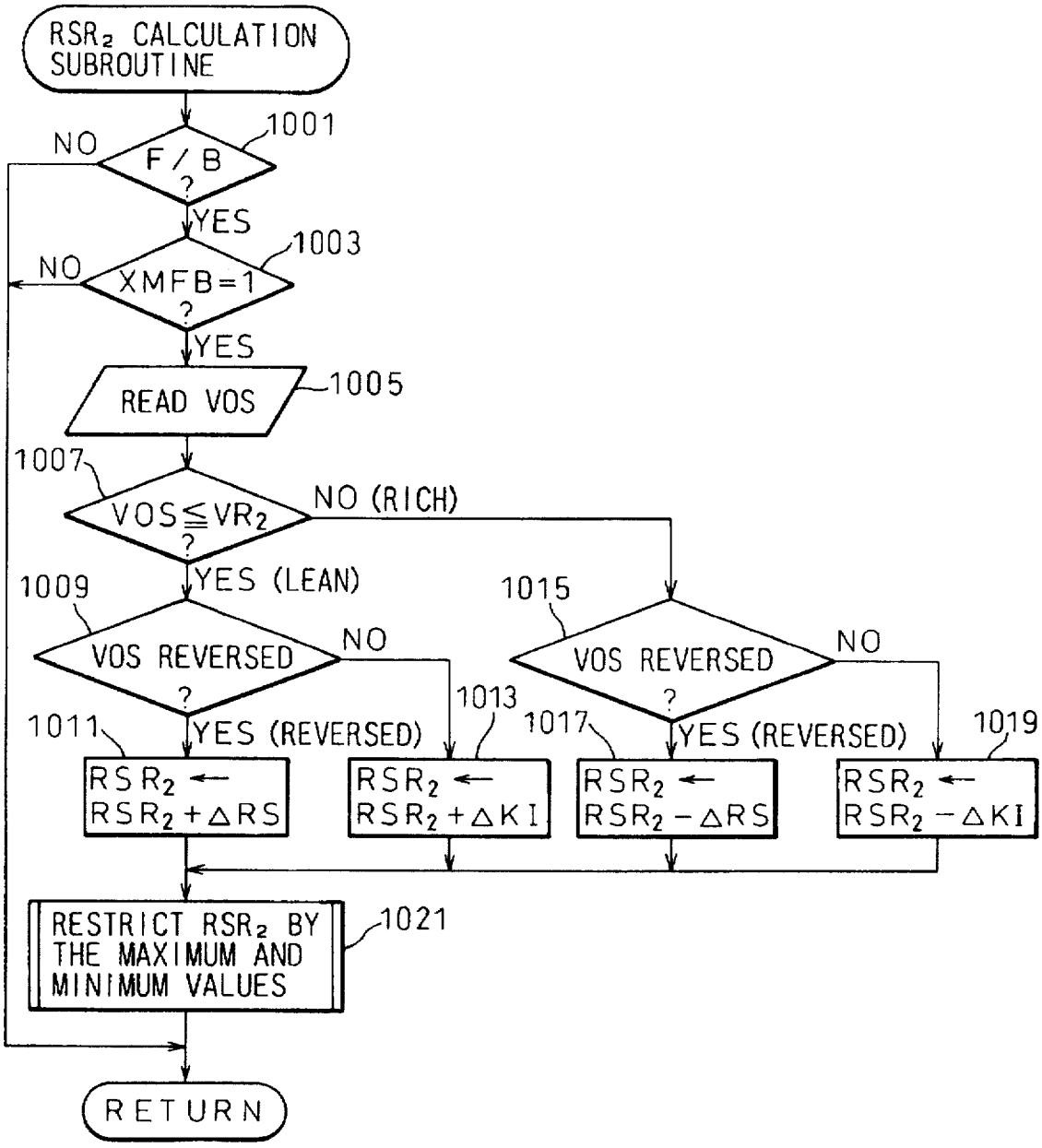
FIG. 10 shows a flowchart illustrating a routine for calculating a second air-fuel ratio sub-correction factor.
Figure 11:
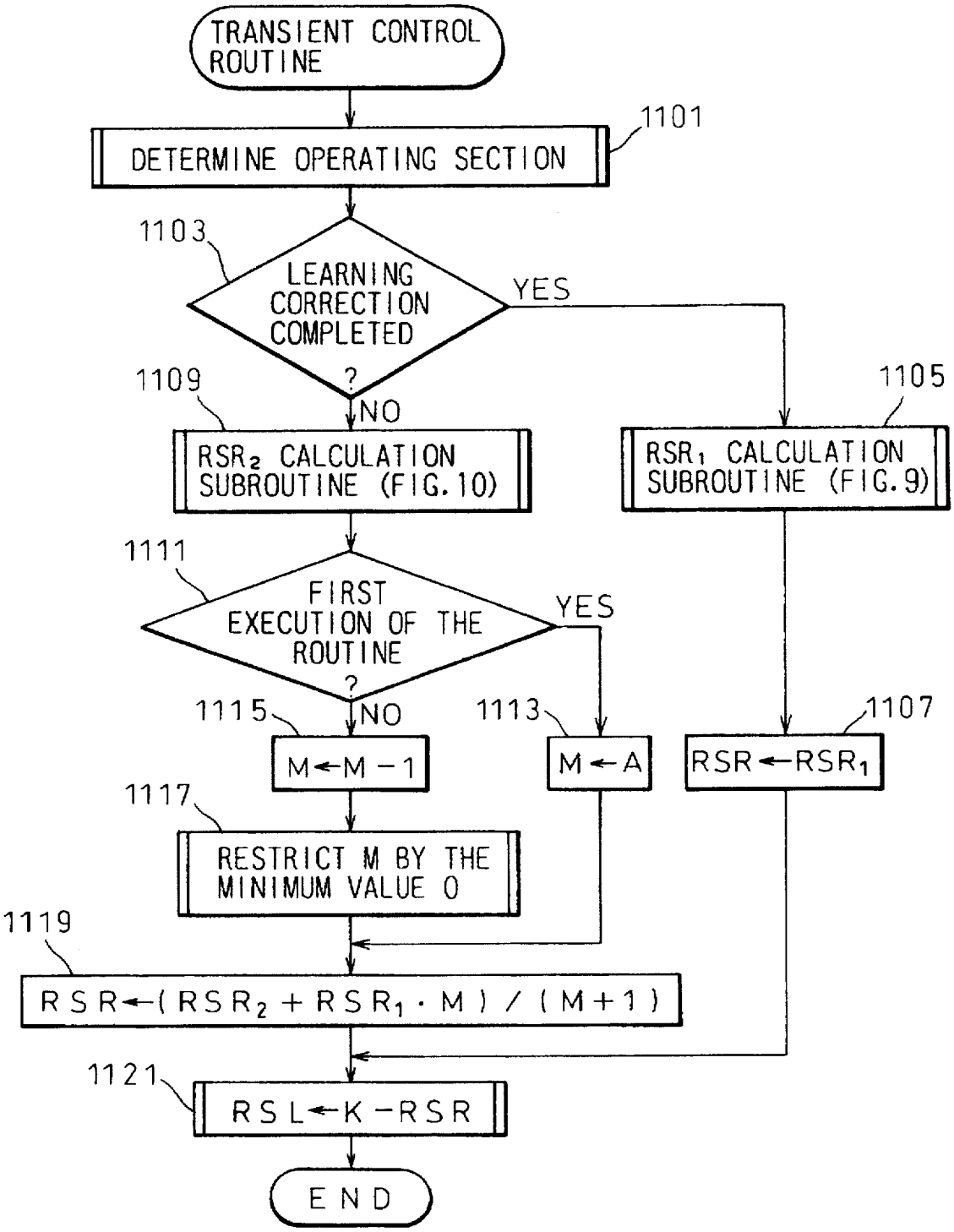
FIG. 11 shows a flowchart illustrating an embodiment of a transient control.

FIGS. 9 through 11 illustrate the transient control of the present embodiment. In this embodiment, when the inlet air amount Q changes from an operating section in which the learning correction is completed (hereinafter, referred to as "a corrected section") to another operating section in which the learning correction is not completed (hereinafter, referred to as "an un-corrected section"), the values of the second air-fuel ratio correction factors RSR and RSL are controlled so that the values of RSR and RSL change gradually from the value in the corrected section to the value corresponding to the current operation of the engine in the un-corrected section. By gradually changing the values of RSR and RSL, the fluctuations of RSR and RSL are suppressed.

FIGS. 9 and 10 show flowcharts of the second air-fuel ratio control of the present embodiment. The routines in FIGS. 9 and 10 are performed by the control circuit 30 instead of the conventional second air-fuel ratio control routine shown by FIG. 4. In this embodiment, two air-fuel ratio sub-correction factors, i.e., a first air-fuel ratio sub-correction factor $RSR_1$ and a second air-fuel ratio sub-correction factor $RSR_2$ are used to determine the values of the second air-fuel ratio correction factors RSR and RSL.

The values of $RSR_1$ and $RSR_2$ are calculated by the subroutines in FIG. 9 and FIG. 10, respectively. In the subroutines in FIG. 9 and FIG. 10, the values of $RSR_1$ and $RSR_1$ are calculated in accordance with the output of the downstream $O_2$ sensor 29, in the same manner as the calculation of RSR in the conventional routine in FIG. 4. Since the flowcharts in FIG. 9 and FIG. 10 are almost same as the flowchart in FIG. 4, the detailed explanation is not given here.

FIG. 11 shows a flowchart of a transient control routine which controls the values of the second air-fuel ratio correction factor RSR and RSL based on the values of the first and the second air-fuel ratio sub-correction factors $RSR_1$ and $RSR_2$ when the operating section of the engine is changed. The routine in FIG. 11 is executed by the control circuit 30 at predetermined regular intervals.

At step 1101 in FIG. 11, the current operating sections of the engine is determined based on the intake air amount Q of the engine, and at step 1103, it is determined whether the learning corrections by KG and FGPG are completed in the current operating section. The determination of whether the learning correction is completed is performed based on the value of FAFAV. If the value of FAFAV when the engine is last operated in this section is within the range $(1-\alpha) \leqq FAFAV \leqq (1+\beta)$, it is considered that the learning correction is completed in the current operating section. In this case, the routine proceeds to step 1105 to perform the subroutine in FIG. 9. Namely, when the learning correction is completed in the current operating section, the value of the first air-fuel ratio sub-correction factor $RSR_1$ is calculated. The routine, then sets the value of the second air-fuel ratio correction factor RSR at the calculated value of $RSR_1$ at step 1107 and calculates the value of the second air-fuel ratio correction factor RSL by RSL=K−RSR at step 1121 (K is a constant, and the value of K is set at about 0.1 in this embodiment). In this embodiment, the values RSR and RSL set by the routine in FIG. 11 is used in the first air-fuel ratio control routine (FIGS. 2 and 3). Therefore, once the learning correction is completed, the same air-fuel ratio control as the conventional routine (FIGS. 2, 3 and 4) is performed also in this embodiment.

On the other hand, if the learning correction is not completed in the current operating section, the routine proceeds to step 1109 which performs the subroutine in FIG. 10. Namely, when the learning correction is not completed in the current operating section, the value of the second air-fuel ratio sub-correction factor $RSR_2$ instead of $RSR_1$ is calculated in accordance with the output of the downstream $O_2$ sensor 29. After calculating the value of $RSR_2$, the routine determines at step 1111 whether the routine is first executed after the operating section changed. If the routine is first executed after the operating section changed, the value of a smoothing factor M is set at a predetermined value A at step 1113. If the execution of the routine is not the first execution after the operating section at step 1111, the value of the smoothing factor M is reduced by 1 at step 1115, and the value of M after it is reduced is restricted by 0 at step 1117. Therefore, by executing steps 1111 through 1117, the smoothing factor M is first set at the initial value of A when the operating section changed, and thereafter, reduced by one every time the routine is executed. At step 1119, the value of the second air-fuel ratio correction factor RSR is calculated by a smoothing calculation. In this embodiment, the value of RSR is calculated as a weighting mean of the values of $RSR_2$ and $RSR_1$ using a weighting factor M.

Namely, $RSR=\{(RSR_1 \times M)+RSR_2\}/(M+1)$.

When the learning correction is not completed, step 1105 (the subroutine in FIG. 9) is not executed. Therefore, the value of $RSR_1$ used in the above formula is the value of $RSR_1$ when the routine was last executed in the corrected section in which the learning correction was completed (i.e., the value of $RSR_1$ in the above formula is maintained constant). On the other hand, the value $RSR_2$ is calculated by the subroutine in FIG. 10 in a condition in which the learning correction was not completed and, thereby the value of $RSR_2$ fluctuates largely. However, in this embodiment, since the second air-fuel ratio correction factor RSR is calculated as a weighting mean of $RSR_1$ (constant) and $RSR_2$ (fluctuating), the influence of the fluctuation of $RSR_2$ becomes small and, thereby the fluctuation of the second air-fuel ratio correction factor RSR is smoothed (i.e., suppressed). Further, as explained above, the value of the weighting factor M is reduced by 1 every time when the routine is executed, and becomes 0 after a certain time has elapsed. Therefore, if the initial value A of the weighting factor is set at a large value, the value of RSR becomes nearly equal to the value of $RSR_1$ when the operating section changes, and gradually approaches the value of $RSR_2$ thereafter as the weighting factor M decreases. Namely, when the operating section changes, the value of the second air-fuel ratio correction factor RSR gradually changes from the value RSR, to $RSR_2$. Therefore, the value of RSR does not fluctuate even when the operating section changes. Accordingly, the value of FAFAV comes to agree with the center value of the fluctuation of FAF since the fluctuation of the value of FAF becomes almost symmetrical. Therefore, the error in the learning correction does not occur. Further, since the value of RSR gradually approaches the value of $RSR_2$, the second air-fuel ratio control, i.e., compensation of the deviation of the characteristics of the upstream $O_2$ sensor 28 is also carried out. Therefore, according to the present embodiment, an accurate learning correction is performed when the operating section changes, without interrupting the second air-fuel ratio control.

Though the transient control in FIG. 11 is directed to the learning correction using KG, similar transient control may be performed for the learning correction using FGPG. Usually, since the purge ratio is controlled so that it changes gradually, the transient control for the learning correction by the FGPG is not required. However, if the case in which the purge ratio changes suddenly is possible, a transient control for the learning correction by FGPG similar to the above-explained transient control may be carried out.

Next, another embodiment of the present invention is explained with reference to FIG. 12. In this embodiment, the value of RSR is also gradually changed from $RSR_1$ to $RSR_2$, when the intake air amount Q changed from the corrected section to the un-corrected section. However, in this embodiment, if the change in the value of KG due to the change in the operating section is smaller than a predetermined amount, transient control is not carried out, i.e., it is determined that the learning correction is completed in the new section even if it is not actually completed. If the change in the value of KG due to the change in the operating section is small, the fluctuations of the value of FAF and RSR becomes small. Therefore, if the value of KG does not change much when the operating section changes, an error in the learning correction hardly occurs. In this case, it is rather preferable to perform the second air-fuel ratio control immediately after the change in the operating section, to thereby control the air-fuel ratio of the engine accurately. Therefore, when the change in the value of KG is smaller than the predetermined value, transient control is not performed in this embodiment.

Figure 12:
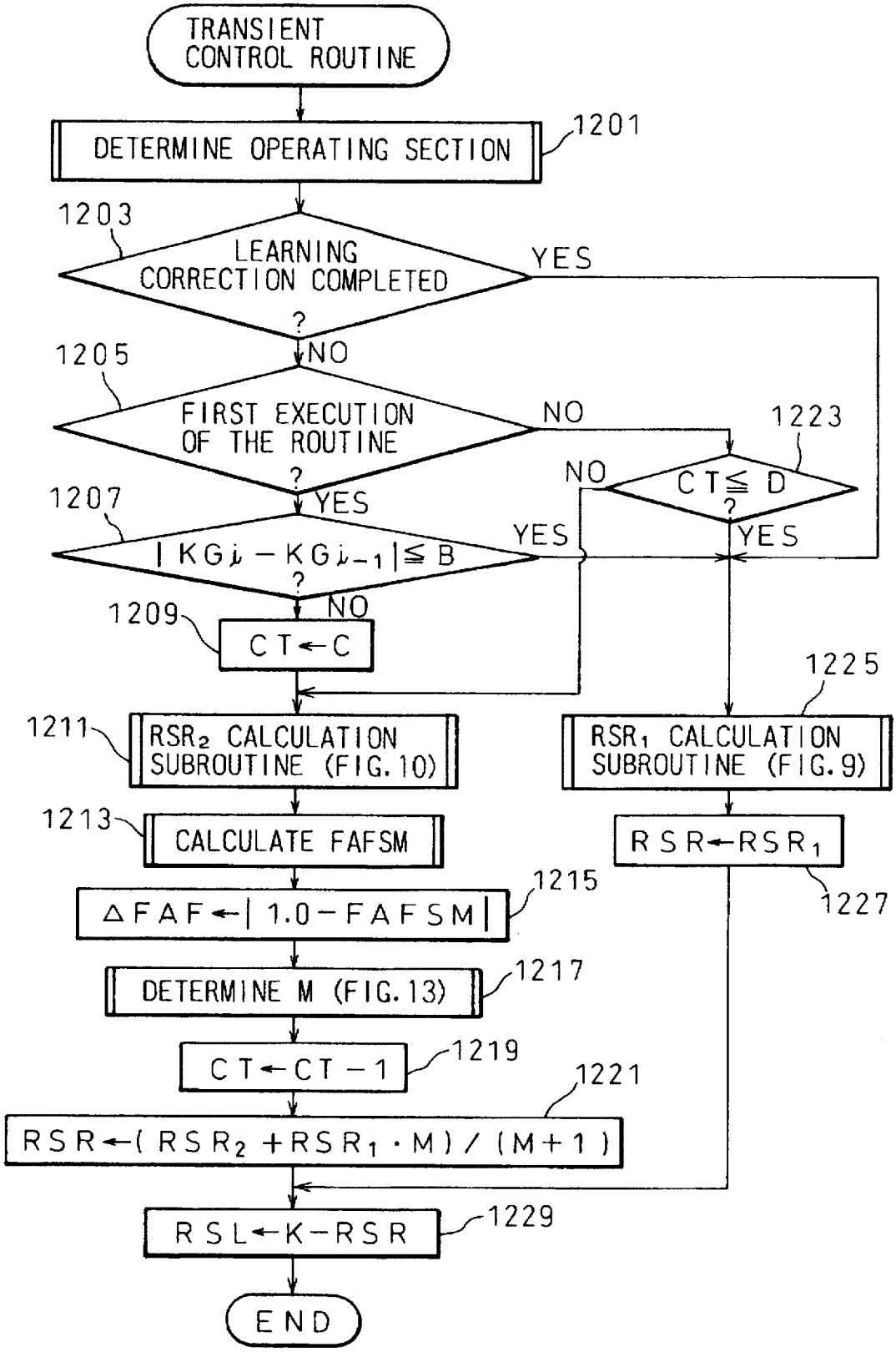
FIG. 12 shows a flowchart illustrating another embodiment of a transient control.

In FIG. 12, at steps 1201 and 1203, the operating section is determined in accordance with the intake air amount Q and determination of whether the learning correction is completed in the operating section is carried out, respectively. If the learning correction is completed in the current operating section, steps 1225 through 1229, which are the same as steps 1105, 1107 and 1121, are executed.

If the learning correction is not completed, the routine determines, at step 1205, whether the routine is first performed after the operating section changed. If it is the first execution of the routine after the operating section changed, the routine proceeds to step 1207 to determine whether the difference between the value of the learning correction factor $KG_i$ in the current operating section and the learning correction factor $KG_{i-1}$ in the former operating section is smaller than a predetermined value B. The value $KG_{i-1}$ is stored in the backup RAM 34.

If the difference is smaller than B, i.e., if $|KG_i-KG_{i-1}|\leqq B$ at step 1207, since it is considered that the transient control is not necessary, the routine proceeds to step 1225 to perform the same air-fuel ratio control as that when the learning correction is completed. If $|KG_i-KG_{i-1}|>B$ at step 1207, the value of a counter CT is set at a predetermined initial value C at step 1209, and the transient control in the steps 1211 through 1221 is performed. The value of the counter CT is set at the initial value C when the routine is first executed in the current operating section, and is reduced by 1 thereafter at step 1219 every time the routine is executed. Therefore, the value of the counter CT corresponds to the time lapsed since the operating section has changed. The counter CT is used for determining the timing for terminating the transient control of steps 1211 through 1221. Namely, if it is not the first execution of the routine since the operating section changed, the routine proceeds from step 1205 to 1223 to determine whether the value of the counter CT becomes less than or equal to a predetermined value D, and only when $CT\leqq D$ at step 1223, is the transient control of steps 1211 through 1221 performed. In other words, the transient control is performed only for a predetermined time period after the operating section has changed.

In the transient control of the present embodiment, similarly to the routine in FIG. 11, RSR is calculated as a weighting means between the value of $RSR_2$ calculated by the subroutine in FIG. 10 (step 1211) and the value of $RSR_1$ in the operating section in which the learning correction is last completed (step 1221). However, the weighting factor M in the calculation of the value RSR is set differently from that in the embodiment in FIG. 11.

In this embodiment, first the smoothed value of FAF is calculated at step 1213 by a weighting mean calculation using a weighting factor N (N is a constant), i.e., by $FAFSM=\{(FAFSM_{i-1}\times N)+FAF)\}/(N+1)$. FAFSM is a smoothed value of FAF and, $FAFSM_{i-1}$ is the smoothed value of FAF calculated when the routine was last executed. Then a value ΔFAF, which is the deviation of FAFSM from the reference value 1.0 is calculated at step 1215. The value of the weighting factor M in this embodiment is determined in accordance with the magnitude of the deviation ΔFAF.

Figure 13:
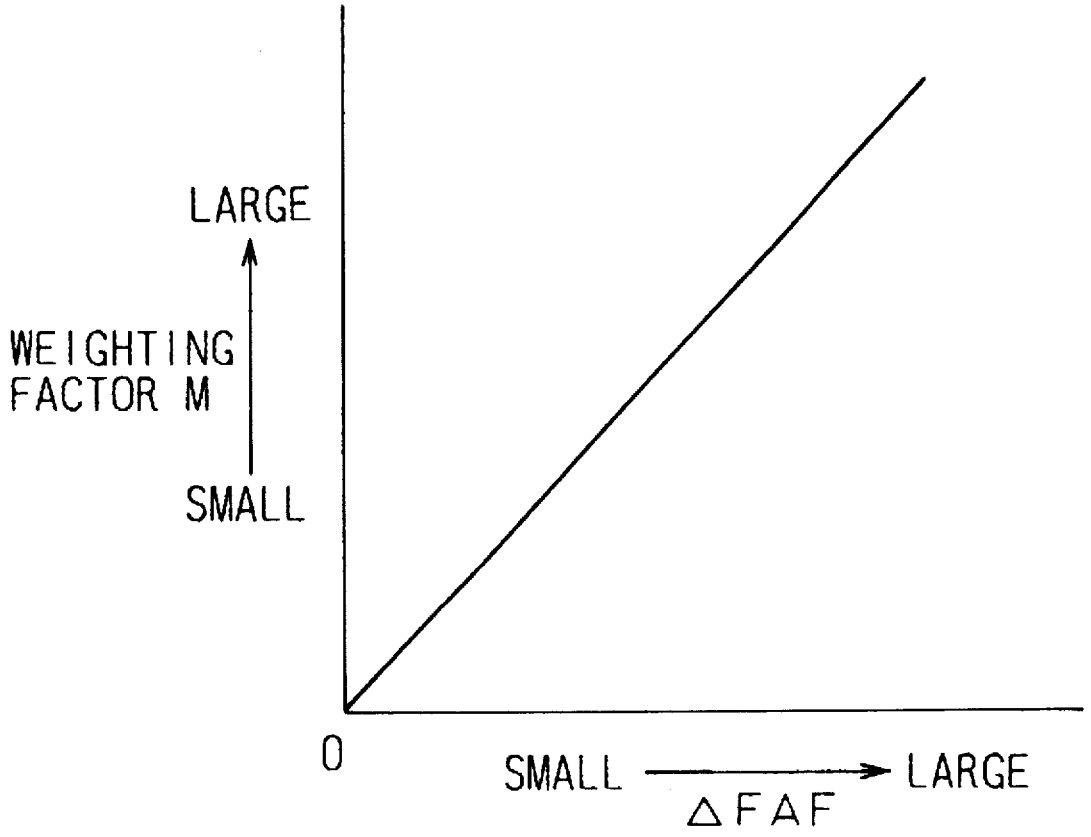
FIG. 13 shows the setting of the value of a coefficient used in the flowchart in FIG. 12.

FIG. 13 show the relationships between the deviation ΔFAF and the setting of the weighting factor M in this embodiment. As shown in FIG. 13, the value of the weighting factor M increases in proportion to the value of the deviation ΔFAF. As explained before, when the smoothing calculation is carried out, the calculated (smoothed) value FAFSM becomes stable even though the original value of FAF fluctuates largely. Therefore, the value ΔFAF represents the deviation of FAF as a whole from the reference value accurately. When the air-fuel ratio (FAF) deviates from the target air-fuel ratio, the fluctuation of the value of $RSR_2$ becomes large. Therefore, by setting the value of weighting factor M based on the relationships in FIG. 13, since the value of M is set larger as the FAF as a whole deviates from the reference value, the influence of the fluctuation of the value $RSR_2$ becomes smaller as the fluctuation of the value $RSR_2$ becomes larger.

The value of FAFSM approaches the reference value as the learning correction by KG proceeds. Therefore, the value of the weighting factor M gradually decreases, and the value of RSR gradually approaches the value of $RSR_2$ also in this embodiment. Thus, similarly to the embodiment in FIG. 11, accurate air-fuel ratio control can be achieved while preventing an error in the learning correction by KG. The weighting factor N in step 1211 and the relationships between the weighting factor M and the deviation ΔFAF varies in accordance with the type of engine, and is preferably obtained by experiment using an actual engine.

Though the transient control is carried out when the operating section changes from the corrected section to the un-corrected section in the embodiments in FIG. 11 and FIG. 12, in some cases, transient control is also required when the operating section changes in the reverse direction. When the operating section changes from the un-corrected section to the corrected section, theoretically the fluctuation of RSR becomes small, and the value of FAF converges around the reference value. However, in the actual engine, the change in the exhaust gas downstream of the catalytic converter is delayed compared to the change in the exhaust gas upstream of the catalytic converter. Since the value of RSR is calculated in accordance with the downstream $O_2$ sensor 29, the fluctuation of the value of RSR sometimes continues for a certain period even after the operating section is changed from the un-corrected section to the corrected section. If the value of RSR fluctuates in the corrected section, the value of FAFAV starts to fluctuate again, as explained before. If this fluctuations occur in the corrected section, the routines in FIG. 11 and FIG. 12 may determine that the learning correction is not completed even if it is actually completed. Therefore, when the fluctuation of RSR is large after the operating section changes to the corrected section, the learning correction by KG may be performed based on the fluctuating value of FAFAV and, thereby, cause an error in the learning correction. Therefore, the transient control similar to those in FIG. 11 and 12 may be performed also when the operating section changes from the un-corrected section to the corrected section.

Next another embodiment is explained with reference to FIGS. 14 through 16. In the embodiments in FIG. 11 and 12, two air-fuel ratio sub-correction factors $RSR_1$ and $RSR_2$ are used to suppress the fluctuation of the value of RSR. However, in the present embodiment, the fluctuation of the value of RSR is suppressed by adjusting the rate of the change in the value of RSR in accordance with the deviation of the value of FAF from the reference value when the learning correction is not completed.

When the rate of change in the value of RSR is always set at a large value, the fluctuation of the values RSR and RSL become large when FAF deviates from the reference value and, thereby the error in the learning correction may occur, as explained before. Further, if the rate of change in the values of RSR and RSL is always set at a small value, the time required for the second air-fuel ratio control to correct the deviation of the characteristics of the upstream $O_2$ sensor becomes longer. Therefore, the rate of change in the values of RSR and RSL are controlled in this embodiment in such a manner that the rate of the change in the values of RSR and RSL becomes smaller as the deviation of FAF from the reference value becomes larger.

Figure 16:
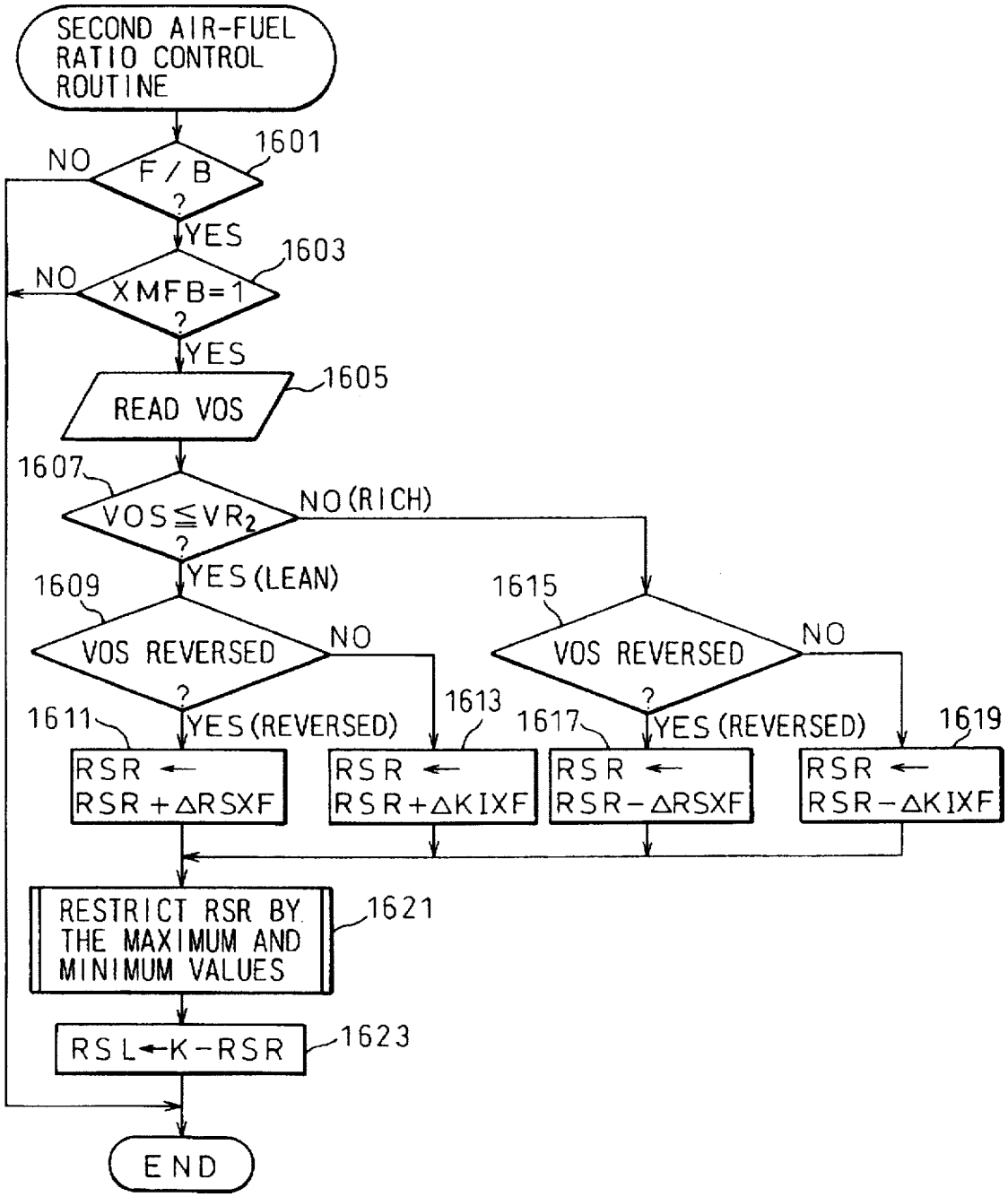
FIG. 16 shows a flowchart illustrating a routine for calculating the second air-fuel ratio correction factor using the coefficient determined by the routine in FIG. 14.

FIG. 16 shows a flowchart of the second air-fuel ratio control in this embodiment. The flow chart in FIG. 16 is the same as the flow chart of the conventional second air-fuel ratio control except that, in FIG. 16, the amount ΔRS in steps 411, 417 and the amount ΔKI in steps 413, 419 in FIG. 4 are replaced with ΔRS×F in steps 1611, 1617 and ΔKI×F in steps 1613, 1619, respectively. The value of the factor F is adjusted in accordance with the deviation of FAF from the reference value. Namely, in the second air-fuel ratio control routine in FIG. 16, the rate of the change in the value of RSR is adjusted by adjusting the amount of the change in RSR per every execution of the routine (ΔRS and ΔKI).

Figure 14:
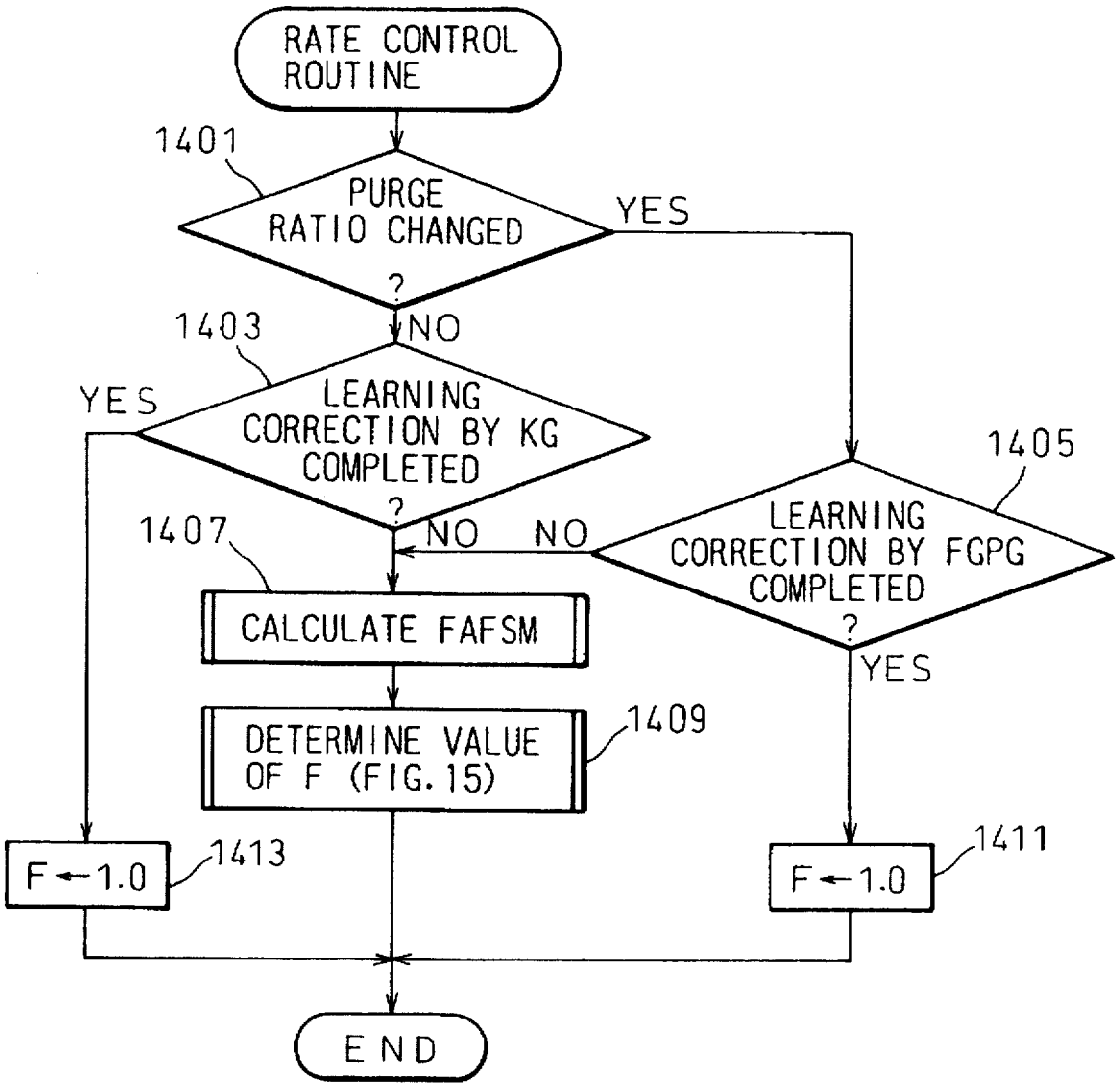
FIG. 14 shows a flowchart illustrating a routine for setting the rate of the change in the value of the second air-fuel ratio correction factor.
Figure 15:
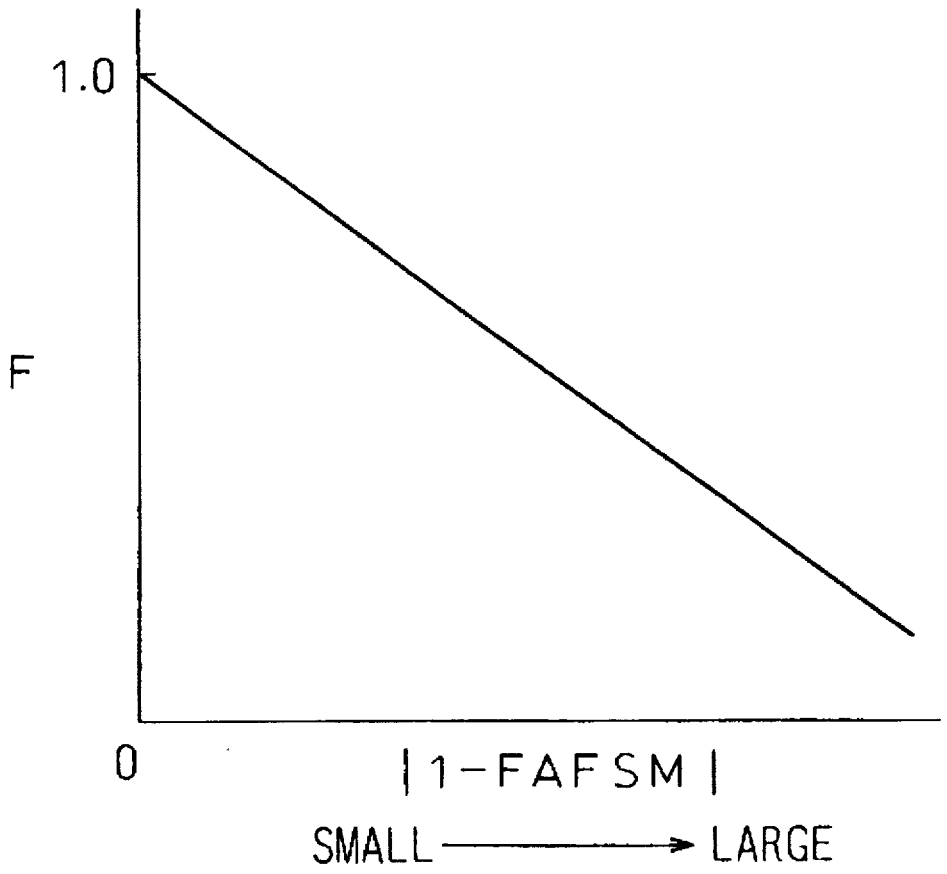
FIG. 15 shows the setting of the value of a coefficient used in the flowchart in FIG. 15.

FIG. 14 shows a flowchart for determining the value of F used in the second air-fuel ratio control routine in FIG. 16. The routine in FIG. 14 is executed by the control circuit 30 at predetermined regular intervals.

In FIG. 14, at step 1401, it is determined whether the purge ratio of the engine is changed since the routine was last executed, i.e., whether the learning correction by the FGPG is required. If the purge ratio is changed, the routine proceeds to step 1405 to determine whether the learning correction by FGPG is completed. If the purge ratio is not changed at step 1401, it is determined whether the learning correction by KG is completed at step 1403. If it is determined that the learning correction by KG is completed at step 1403, or if it is determined that the learning correction by FGPG is completed at step 1405, the value of the factor F is set at 1.0 at step 1413 or step 1411, respectively. In this case, since the flowchart in FIG. 16 becomes exactly the same as the flowchart in FIG. 4, the conventional second air-fuel ratio control is carried out.

If either of the learning corrections is not completed at steps 1403 or 1405, the smoothing value FAFSM is calculated at step 1407 in the same manner as that in step 1213 in FIG. 12. Then at step 1409, the value of the factor F is determined in accordance with the deviation of FAFSM from the reference value 1.0. FIG. 15 shows the relationship between the value of F set at step 1409 and the deviation of FAFSM from the reference value (i.e., |1.0–FAFSM|). As shown in FIG. 15, the value of F becomes smaller as the deviation |1.0–FAFSM| becomes larger. Since the rate of the change in RSR becomes smaller as the value of F becomes smaller in the second air-fuel ratio control routine in FIG. 16, the rate of the change in PSP, becomes smaller as the deviation of FAFSM becomes larger in this embodiment. Thus, when the learning correction is not completed, the fluctuation of RSR, and the fluctuation of FAFAV are suppressed and, thereby the error in the learning correction is prevented from occurring. Further, as explained above, when the learning correction is completed, since the value of F is set at 1.0 (steps 1411 or 1413), the rate of the change of RSR is returned to normal value to increase the response of the second air-fuel ratio control.

As explained above, according to the present invention, an error in the learning correction is prevented from occurring without interrupting the second air-fuel ratio control.

I claim:

1. An air-fuel ratio control device for an internal combustion engine comprising:

a catalytic converter disposed in an exhaust gas passage of an engine;

an upstream air-fuel ratio sensor disposed in the exhaust gas passage upstream of the catalytic converter for detecting an air-fuel ratio of the exhaust gas upstream of the catalytic converter;

a downstream air-fuel ratio sensor disposed in the exhaust passage downstream of the catalytic converter for detecting the air-fuel ratio of the exhaust gas downstream of the catalytic converter;

first air-fuel ratio control means for setting the value of a first air-fuel ratio correction factor in accordance with the value of a second air-fuel ratio correction factor and the output of the upstream air-fuel ratio sensor;

second air-fuel ratio control means for setting the value of the second air-fuel ratio correction factor in accordance with the output of the downstream air-fuel ratio sensor;

learning correction means for performing a learning correction of the first air-fuel ratio correction factor by adjusting the value of a learning correction factor in such a manner that a center value of the fluctuation of the first air-fuel ratio correction factor agrees with a predetermined reference value;

fuel supply control means for controlling the amount of fuel supplied to the engine in accordance with the values of said first air-fuel ratio correction factor and said learning correction factor;

determining means for determining whether the learning correction by the learning correction means has been completed; and transient control means for controlling said second air-fuel ratio control means in such a manner that the rate of change in the value of the second air-fuel ratio correction factor becomes smaller when the learning correction has not completed than after the learning correction has completed.

2. An air-fuel ratio control device according to claim 1, wherein said second air-fuel ratio control means comprises a first air-fuel ratio sub-correction means for setting the value of a first air-fuel ratio sub-correction factor in accordance with the output of the downstream air-fuel ratio sensor when the learning correction has completed, a second air-fuel ratio sub-correction means for setting the value of a second air-fuel ratio sub-correction factor in accordance with the output of the downstream air-fuel ratio sensor when the learning correction has not completed, and a memory means for storing the latest value of said first air-fuel ratio sub-correction factor, and wherein said transient control means controls said second air-fuel ratio control means in such a manner that said second air-fuel ratio control means sets the value of the second air-fuel ratio correction factor at the same value as the second air-fuel ratio sub-correction factor when the learning correction has completed, and that the second air-fuel ratio control means gradually changes the value of the second air-fuel ratio correction factor from the latest value of the first air-fuel ratio sub-correction factor stored in the memory means to the value of the second air-fuel ratio sub-correction factor set by the second air-fuel ratio sub-correction means when the learning correction has not completed.

3. An air-fuel ratio control device according to claim 2, wherein said learning correction means divides the operating range of the engine into plural operating sections and performs the learning correction for each of the operating sections separately to set the value of the learning correction factor in the respective operating sections, said determining means comprises a learning correction factor storing means for storing the value of the learning correction factor of the operating section in which the learning correction was last completed, and wherein, when the operating condition of the engine changes from a operating section in which the learning correction has completed to a operating section in which the learning correction has not completed, the determining means determines that the learning correction has completed in the latter operating section when the difference between the value of the learning correction factor of the latter operating section and the value of the learning correction factor stored by the learning correction factor storing means is smaller than a predetermined value.

4. An air-fuel ratio control device according to claim 1, wherein said transient control means controls the second air-fuel ratio control means in such a manner that the rate of the change in the value of the second air-fuel ratio correction factor becomes smaller as the deviation of the value of the first air-fuel ratio correction factor from the reference becomes larger.

* * * * *